US011668175B2

(12) United States Patent
Yeung et al.

(10) Patent No.: US 11,668,175 B2
(45) **Date of Patent: *Jun. 6, 2023**

(54) AUTOMATED DIAGNOSTICS OF ELECTRONIC INSTRUMENTATION IN A SYSTEM FOR FRACTURING A WELL AND ASSOCIATED METHODS

(71) Applicant: BJ Energy Solutions, LLC, Houston, TX (US)

(72) Inventors: Tony Yeung, Houston, TX (US); Ricardo Rodriguez-Ramon, Houston, TX (US); Andres Alvarez, Houston, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/955,844

(22) Filed: Sep. 29, 2022

(65) Prior Publication Data

US 2023/0015511 A1 Jan. 19, 2023

Related U.S. Application Data

(63) Continuation of application No. 17/810,877, filed on Jul. 6, 2022, now Pat. No. 11,512,571, which is a (Continued)

(51) Int. Cl.
*E21B 43/26* (2006.01)
*E21B 47/07* (2012.01)

(52) U.S. Cl.
CPC ..... *E21B 43/2607* (2020.05); *E21B 47/07* (2020.05)

(58) Field of Classification Search
CPC ..... E21B 43/2607; E21B 47/07
See application file for complete search history.

(56) References Cited

U.S. PATENT DOCUMENTS 1,716,049 A 6/1929 Greve
1,726,633 A 9/1929 Smith
(Continued)

FOREIGN PATENT DOCUMENTS

AU 9609498 7/1999
AU 737970 9/2001
(Continued)

OTHER PUBLICATIONS

US 11,459,865 B2, 10/2022, Cui et al. (withdrawn)
(Continued)

*Primary Examiner* — Brad Harcourt
(74) *Attorney, Agent, or Firm* — Womble Bond Dickinson (US) LLP

(57) ABSTRACT

Systems and methods for identifying a status of components of hydraulic fracturing units including a prime mover and a hydraulic fracturing pump to pump fracturing fluid into a wellhead via a manifold may include a diagnostic control assembly. The diagnostic control assembly may include sensors associated with the hydraulic fracturing units or the manifold, and a supervisory control unit to determine whether the sensors are generating signals outside a calibration range, determine whether a fluid parameter associated with an auxiliary system of the hydraulic fracturing units is indicative of a fluid-related problem, determine whether lubrication associated with the prime mover, the hydraulic fracturing pump, or a transmission of the hydraulic fracturing units has a lubrication fluid temperature greater than a maximum lubrication temperature, or determine an extent to which a heat exchanger assembly associated with the hydraulic fracturing units is cooling fluid passing through the heat exchanger assembly.

20 Claims, 10 Drawing Sheets

Related U.S. Application Data continuation of application No. 17/551,359, filed on Dec. 15, 2021, now Pat. No. 11,506,040, which is a continuation of application No. 17/395,298, filed on Aug. 5, 2021, now Pat. No. 11,255,174, which is a continuation of application No. 17/301,247, filed on Mar. 30, 2021, now Pat. No. 11,220,895.

(60) Provisional application No. 62/705,375, filed on Jun. 24, 2020.

(56) References Cited

U.S. PATENT DOCUMENTS

| | | | |
|---|---|---|---|
| 2,178,662 | A | 11/1939 | Lars |
| 2,427,638 | A | 9/1947 | Vilter |
| 2,498,229 | A | 2/1950 | Adler |
| 2,535,703 | A | 12/1950 | Smith et al. |
| 2,572,711 | A | 10/1951 | Fischer |
| 2,820,341 | A | 1/1958 | Amann |
| 2,868,004 | A | 1/1959 | Runde |
| 2,940,377 | A | 6/1960 | Darnell et al. |
| 2,947,141 | A | 8/1960 | Russ |
| 2,956,738 | A | 10/1960 | Rosenschold |
| 3,068,796 | A | 12/1962 | Pfluger et al. |
| 3,191,517 | A | 6/1965 | Solzman |
| 3,257,031 | A | 6/1966 | Dietz |
| 3,274,768 | A | 9/1966 | Klein |
| 3,378,074 | A | 4/1968 | Kiel |
| 3,382,671 | A | 5/1968 | Ehni, III |
| 3,401,873 | A | 9/1968 | Privon |
| 3,463,612 | A | 8/1969 | Whitsel |
| 3,496,880 | A | 2/1970 | Wolff |
| 3,550,696 | A | 12/1970 | Kenneday |
| 3,586,459 | A | 6/1971 | Zerlauth |
| 3,632,222 | A | 1/1972 | Cronstedt |
| 3,656,582 | A | 4/1972 | Alcock |
| 3,667,868 | A | 6/1972 | Brunner |
| 3,692,434 | A | 9/1972 | Schnear |
| 3,739,872 | A | 6/1973 | McNair |
| 3,757,581 | A | 9/1973 | Mankin |
| 3,759,063 | A | 9/1973 | Bendall |
| 3,765,173 | A | 10/1973 | Harris |
| 3,771,916 | A | 11/1973 | Flanigan et al. |
| 3,773,438 | A | 11/1973 | Hall et al. |
| 3,786,835 | A | 1/1974 | Finger |
| 3,791,682 | A | 2/1974 | Mitchell |
| 3,796,045 | A | 3/1974 | Foster |
| 3,814,549 | A | 6/1974 | Cronstedt |
| 3,820,922 | A | 6/1974 | Buse et al. |
| 3,847,511 | A | 11/1974 | Cole |
| 3,866,108 | A | 2/1975 | Yannone |
| 3,875,380 | A | 4/1975 | Rankin |
| 3,963,372 | A | 6/1976 | McLain et al. |
| 4,010,613 | A | 3/1977 | McInerney |
| 4,019,477 | A | 4/1977 | Overton |
| 4,031,407 | A | 6/1977 | Reed |
| 4,050,862 | A | 9/1977 | Buse |
| 4,059,045 | A | 11/1977 | McClain |
| 4,086,976 | A | 5/1978 | Holm et al. |
| 4,117,342 | A | 9/1978 | Melley, Jr. |
| 4,173,121 | A | 11/1979 | Yu |
| 4,204,808 | A | 5/1980 | Reese et al. |
| 4,209,079 | A | 6/1980 | Marchal et al. |
| 4,209,979 | A | 7/1980 | Woodhouse et al. |
| 4,222,229 | A | 9/1980 | Uram |
| 4,269,569 | A | 5/1981 | Hoover |
| 4,311,395 | A | 1/1982 | Douthitt et al. |
| 4,330,237 | A | 5/1982 | Battah |
| 4,341,508 | A | 7/1982 | Rambin, Jr. |
| 4,357,027 | A | 11/1982 | Zeitlow |
| 4,383,478 | A | 5/1983 | Jones |
| 4,402,504 | A | 9/1983 | Christian |
| 4,430,047 | A | 2/1984 | Ng |
| 4,442,665 | A | 4/1984 | Fick |
| 4,457,325 | A | 7/1984 | Green |
| 4,470,771 | A | 9/1984 | Hall et al. |
| 4,483,684 | A | 11/1984 | Black |
| 4,505,650 | A | 3/1985 | Hannett et al. |
| 4,574,880 | A | 3/1986 | Handke |
| 4,584,654 | A | 4/1986 | Crane |
| 4,620,330 | A | 11/1986 | Izzi, Sr. |
| 4,672,813 | A | 6/1987 | David |
| 4,754,607 | A | 7/1988 | Mackay |
| 4,782,244 | A | 11/1988 | Wakimoto |
| 4,796,777 | A | 1/1989 | Keller |
| 4,869,209 | A | 9/1989 | Young |
| 4,913,625 | A | 4/1990 | Gerlowski |
| 4,983,259 | A | 1/1991 | Duncan |
| 4,990,058 | A | 2/1991 | Eslinger |
| 5,032,065 | A | 7/1991 | Yamamuro |
| 5,135,361 | A | 8/1992 | Dion |
| 5,167,493 | A | 12/1992 | Kobari |
| 5,245,970 | A | 9/1993 | Iwaszkiewicz et al. |
| 5,291,842 | A | 3/1994 | Sallstrom et al. |
| 5,326,231 | A | 7/1994 | Pandeya |
| 5,362,219 | A | 11/1994 | Paul et al. |
| 5,511,956 | A | 4/1996 | Hasegawa |
| 5,537,813 | A | 7/1996 | Davis et al. |
| 5,553,514 | A | 9/1996 | Walkowc |
| 5,560,195 | A | 10/1996 | Anderson et al. |
| 5,586,444 | A | 12/1996 | Fung |
| 5,622,245 | A | 4/1997 | Reik |
| 5,626,103 | A | 5/1997 | Haws et al. |
| 5,634,777 | A | 6/1997 | Albertin |
| 5,651,400 | A | 7/1997 | Corts et al. |
| 5,678,460 | A | 10/1997 | Walkowc |
| 5,717,172 | A | 2/1998 | Griffin, Jr. et al. |
| 5,720,598 | A | 2/1998 | de Chizzelle |
| 5,761,084 | A | 6/1998 | Edwards |
| 5,811,676 | A | 9/1998 | Spalding et al. |
| 5,839,888 | A | 11/1998 | Harrison |
| 5,846,062 | A | 12/1998 | Yanagisawa et al. |
| 5,875,744 | A | 3/1999 | Vallejos |
| 5,983,962 | A | 11/1999 | Gerardot |
| 5,992,944 | A | 11/1999 | Hara |
| 6,041,856 | A | 3/2000 | Thrasher et al. |
| 6,050,080 | A | 4/2000 | Horner |
| 6,067,962 | A | 5/2000 | Bartley et al. |
| 6,071,188 | A | 6/2000 | O'Neill et al. |
| 6,074,170 | A | 6/2000 | Bert et al. |
| 6,123,751 | A | 9/2000 | Nelson et al. |
| 6,129,335 | A | 10/2000 | Yokogi |
| 6,145,318 | A | 11/2000 | Kaplan et al. |
| 6,230,481 | B1 | 5/2001 | Jahr |
| 6,279,309 | B1 | 8/2001 | Lawlor, II et al. |
| 6,321,860 | B1 | 11/2001 | Reddoch |
| 6,334,746 | B1 | 1/2002 | Nguyen et al. |
| 6,401,472 | B2 | 6/2002 | Pollrich |
| 6,530,224 | B1 | 3/2003 | Conchieri |
| 6,543,395 | B2 | 4/2003 | Green |
| 6,655,922 | B1 | 12/2003 | Flek |
| 6,669,453 | B1 | 12/2003 | Breeden |
| 6,765,304 | B2 | 7/2004 | Baten et al. |
| 6,786,051 | B2 | 9/2004 | Kristich et al. |
| 6,832,900 | B2 | 12/2004 | Leu |
| 6,851,514 | B2 | 2/2005 | Han et al. |
| 6,859,740 | B2 | 2/2005 | Stephenson et al. |
| 6,901,735 | B2 | 6/2005 | Lohn |
| 6,962,057 | B2 | 11/2005 | Kurokawa et al. |
| 7,007,966 | B2 | 3/2006 | Campion |
| 7,047,747 | B2 | 5/2006 | Tanaka |
| 7,065,953 | B1 | 6/2006 | Kopko |
| 7,143,016 | B1 | 11/2006 | Discenzo et al. |
| 7,222,015 | B2 | 5/2007 | Davis et al. |
| 7,281,519 | B2 | 10/2007 | Schroeder |
| 7,388,303 | B2 | 6/2008 | Seiver |
| 7,404,294 | B2 | 7/2008 | Sundin |
| 7,442,239 | B2 | 10/2008 | Armstrong et al. |
| 7,524,173 | B2 | 4/2009 | Cummins |
| 7,545,130 | B2 | 6/2009 | Latham |
| 7,552,903 | B2 | 6/2009 | Dunn et al. |
| 7,563,076 | B2 | 7/2009 | Brunet et al. |
| 7,563,413 | B2 | 7/2009 | Naets et al. |
| 7,574,325 | B2 | 8/2009 | Dykstra |

(56) References Cited

U.S. PATENT DOCUMENTS

| | | | |
|---|---|---|---|
| 7,594,424 | B2 | 9/2009 | Fazekas |
| 7,614,239 | B2 | 11/2009 | Herzog et al. |
| 7,627,416 | B2 | 12/2009 | Batenburg et al. |
| 7,677,316 | B2 | 3/2010 | Butler et al. |
| 7,721,521 | B2 | 5/2010 | Kunkle et al. |
| 7,730,711 | B2 | 6/2010 | Kunkle et al. |
| 7,779,961 | B2 | 8/2010 | Matte |
| 7,789,452 | B2 | 9/2010 | Dempsey et al. |
| 7,836,949 | B2 | 11/2010 | Dykstra |
| 7,841,394 | B2 | 11/2010 | McNeel et al. |
| 7,845,413 | B2 | 12/2010 | Shampine et al. |
| 7,861,679 | B2 | 1/2011 | Lemke et al. |
| 7,886,702 | B2 | 2/2011 | Jerrell et al. |
| 7,900,724 | B2 | 3/2011 | Promersberger et al. |
| 7,921,914 | B2 | 4/2011 | Bruins et al. |
| 7,938,151 | B2 | 5/2011 | Höckner |
| 7,955,056 | B2 | 6/2011 | Pettersson |
| 7,980,357 | B2 | 7/2011 | Edwards |
| 8,056,635 | B2 | 11/2011 | Shampine et al. |
| 8,083,504 | B2 | 12/2011 | Williams et al. |
| 8,099,942 | B2 | 1/2012 | Alexander |
| 8,186,334 | B2 | 5/2012 | Ooyama |
| 8,196,555 | B2 | 6/2012 | Ikeda et al. |
| 8,202,354 | B2 | 6/2012 | Iijima |
| 8,316,936 | B2 | 11/2012 | Roddy |
| 8,336,631 | B2 | 12/2012 | Shampine et al. |
| 8,388,317 | B2 | 3/2013 | Sung |
| 8,414,673 | B2 | 4/2013 | Raje et al. |
| 8,469,826 | B2 | 6/2013 | Brosowske |
| 8,500,215 | B2 | 8/2013 | Gastauer |
| 8,506,267 | B2 | 8/2013 | Gambier et al. |
| 8,575,873 | B2 | 11/2013 | Peterson et al. |
| 8,616,005 | B1 | 12/2013 | Cousino, Sr. et al. |
| 8,621,873 | B2 | 1/2014 | Robertson et al. |
| 8,641,399 | B2 | 2/2014 | Mucibabic |
| 8,656,990 | B2 | 2/2014 | Kajaria et al. |
| 8,672,606 | B2 | 3/2014 | Glynn et al. |
| 8,707,853 | B1 | 4/2014 | Dille et al. |
| 8,708,667 | B2 | 4/2014 | Collingborn |
| 8,714,253 | B2 | 5/2014 | Sherwood et al. |
| 8,757,918 | B2 | 6/2014 | Ramnarain et al. |
| 8,763,583 | B2 | 7/2014 | Hofbauer et al. |
| 8,770,329 | B2 | 7/2014 | Spitler |
| 8,784,081 | B1 | 7/2014 | Blume |
| 8,789,601 | B2 | 7/2014 | Broussard et al. |
| 8,794,307 | B2 | 8/2014 | Coquilleau et al. |
| 8,801,394 | B2 | 8/2014 | Anderson |
| 8,851,186 | B2 | 10/2014 | Shampine et al. |
| 8,851,441 | B2 | 10/2014 | Acuna et al. |
| 8,894,356 | B2 | 11/2014 | Lafontaine et al. |
| 8,905,056 | B2 | 12/2014 | Kendrick |
| 8,951,019 | B2 | 2/2015 | Hains et al. |
| 8,973,560 | B2 | 3/2015 | Krug |
| 8,997,904 | B2 | 4/2015 | Cryer et al. |
| 9,011,111 | B2 | 4/2015 | Lesko |
| 9,016,383 | B2 | 4/2015 | Shampine et al. |
| 9,032,620 | B2 | 5/2015 | Frassinelli et al. |
| 9,057,247 | B2 | 6/2015 | Kumar et al. |
| 9,097,249 | B2 | 8/2015 | Petersen |
| 9,103,193 | B2 | 8/2015 | Coli et al. |
| 9,121,257 | B2 | 9/2015 | Coli et al. |
| 9,140,110 | B2 | 9/2015 | Coli et al. |
| 9,175,810 | B2 | 11/2015 | Hains |
| 9,187,982 | B2 | 11/2015 | Dehring et al. |
| 9,206,667 | B2 | 12/2015 | Khvoshchev et al. |
| 9,212,643 | B2 | 12/2015 | Deliyski |
| 9,222,346 | B1 | 12/2015 | Walls |
| 9,324,049 | B2 | 4/2016 | Thomeer et al. |
| 9,341,055 | B2 | 5/2016 | Weightman et al. |
| 9,346,662 | B2 | 5/2016 | Van Vliet et al. |
| 9,366,114 | B2 | 6/2016 | Coli et al. |
| 9,376,786 | B2 | 6/2016 | Numasawa |
| 9,394,829 | B2 | 7/2016 | Cabeen et al. |
| 9,395,049 | B2 | 7/2016 | Vicknair et al. |
| 9,401,670 | B2 | 7/2016 | Minato et al. |
| 9,410,410 | B2 | 8/2016 | Broussard et al. |
| 9,410,546 | B2 | 8/2016 | Jaeger et al. |
| 9,429,078 | B1 | 8/2016 | Crowe et al. |
| 9,435,333 | B2 | 9/2016 | McCoy et al. |
| 9,488,169 | B2 | 11/2016 | Cochran et al. |
| 9,493,997 | B2 | 11/2016 | Liu et al. |
| 9,512,783 | B2 | 12/2016 | Veilleux et al. |
| 9,534,473 | B2 | 1/2017 | Morris et al. |
| 9,546,652 | B2 | 1/2017 | Yin |
| 9,550,501 | B2 | 1/2017 | Ledbetter |
| 9,556,721 | B2 | 1/2017 | Jang et al. |
| 9,562,420 | B2 | 2/2017 | Morris et al. |
| 9,570,945 | B2 | 2/2017 | Fischer |
| 9,579,980 | B2 | 2/2017 | Cryer et al. |
| 9,587,649 | B2 | 3/2017 | Oehring |
| 9,593,710 | B2 | 3/2017 | Laimboeck et al. |
| 9,611,728 | B2 | 4/2017 | Oehring |
| 9,617,808 | B2 | 4/2017 | Liu et al. |
| 9,638,101 | B1 | 5/2017 | Crowe et al. |
| 9,638,194 | B2 | 5/2017 | Wiegman et al. |
| 9,650,871 | B2 | 5/2017 | Oehring et al. |
| 9,656,762 | B2 | 5/2017 | Kamath et al. |
| 9,689,316 | B1 | 6/2017 | Crom |
| 9,695,808 | B2 | 7/2017 | Giessbach et al. |
| 9,739,130 | B2 | 8/2017 | Young |
| 9,764,266 | B1 | 9/2017 | Carter |
| 9,777,748 | B2 | 10/2017 | Lu et al. |
| 9,803,467 | B2 | 10/2017 | Tang et al. |
| 9,803,793 | B2 | 10/2017 | Davi et al. |
| 9,809,308 | B2 | 11/2017 | Aguilar et al. |
| 9,829,002 | B2 | 11/2017 | Crom |
| 9,840,897 | B2 | 12/2017 | Larson |
| 9,840,901 | B2 | 12/2017 | Oering et al. |
| 9,845,730 | B2 | 12/2017 | Betti et al. |
| 9,850,422 | B2 | 12/2017 | Lestz et al. |
| 9,856,131 | B1 | 1/2018 | Moffitt |
| 9,863,279 | B2 | 1/2018 | Laing et al. |
| 9,869,305 | B1 | 1/2018 | Crowe et al. |
| 9,871,406 | B1 | 1/2018 | Churnock et al. |
| 9,879,609 | B1 | 1/2018 | Crowe et al. |
| RE46,725 | E | 2/2018 | Case et al. |
| 9,893,500 | B2 | 2/2018 | Oehring et al. |
| 9,893,660 | B2 | 2/2018 | Peterson et al. |
| 9,897,003 | B2 | 2/2018 | Motakef et al. |
| 9,920,615 | B2 | 3/2018 | Zhang et al. |
| 9,945,365 | B2 | 4/2018 | Hernandez et al. |
| 9,964,052 | B2 | 5/2018 | Millican et al. |
| 9,970,278 | B2 | 5/2018 | Broussard et al. |
| 9,981,840 | B2 | 5/2018 | Shock |
| 9,995,102 | B2 | 6/2018 | Dillie et al. |
| 9,995,218 | B2 | 6/2018 | Oehring et al. |
| 10,008,880 | B2 | 6/2018 | Vicknair et al. |
| 10,008,912 | B2 | 6/2018 | Davey et al. |
| 10,018,096 | B2 | 7/2018 | Wallimann et al. |
| 10,020,711 | B2 | 7/2018 | Oehring et al. |
| 10,024,123 | B2 | 7/2018 | Steffenhagen et al. |
| 10,029,289 | B2 | 7/2018 | Wendorski et al. |
| 10,030,579 | B2 | 7/2018 | Austin et al. |
| 10,036,238 | B2 | 7/2018 | Oehring |
| 10,040,541 | B2 | 8/2018 | Wilson et al. |
| 10,060,293 | B2 | 8/2018 | Del Bono |
| 10,060,349 | B2 | 8/2018 | Álvarez et al. |
| 10,077,933 | B2 | 9/2018 | Nelson et al. |
| 10,082,137 | B2 | 9/2018 | Graham et al. |
| 10,094,366 | B2 | 10/2018 | Marica |
| 10,100,827 | B2 | 10/2018 | Devan et al. |
| 10,107,084 | B2 | 10/2018 | Coli et al. |
| 10,107,085 | B2 | 10/2018 | Coli et al. |
| 10,114,061 | B2 | 10/2018 | Frampton et al. |
| 10,119,381 | B2 | 11/2018 | Oehring et al. |
| 10,125,750 | B2 | 11/2018 | Pfaff |
| 10,134,257 | B2 | 11/2018 | Zhang et al. |
| 10,138,098 | B2 | 11/2018 | Sorensen et al. |
| 10,151,244 | B2 | 12/2018 | Giancotti et al. |
| 10,161,423 | B2 | 12/2018 | Rampen |
| 10,174,599 | B2 | 1/2019 | Shampine et al. |
| 10,184,397 | B2 | 1/2019 | Austin et al. |
| 10,196,258 | B2 | 2/2019 | Kalala et al. |
| 10,221,856 | B2 | 3/2019 | Hernandez et al. |

(56) References Cited

U.S. PATENT DOCUMENTS

| | | | |
|---|---|---|---|
| 10,227,854 | B2 | 3/2019 | Glass |
| 10,227,855 | B2 | 3/2019 | Coli et al. |
| 10,246,984 | B2 | 4/2019 | Payne et al. |
| 10,247,182 | B2 | 4/2019 | Zhang et al. |
| 10,254,732 | B2 | 4/2019 | Oehring et al. |
| 10,267,439 | B2 | 4/2019 | Pryce et al. |
| 10,280,724 | B2 | 5/2019 | Hinderliter |
| 10,287,943 | B1 | 5/2019 | Schiltz |
| 10,288,519 | B2 | 5/2019 | De La Cruz |
| 10,303,190 | B2 | 5/2019 | Shock |
| 10,305,350 | B2 | 5/2019 | Johnson et al. |
| 10,316,832 | B2 | 6/2019 | Byrne |
| 10,317,875 | B2 | 6/2019 | Pandurangan |
| 10,337,402 | B2 | 7/2019 | Austin et al. |
| 10,358,035 | B2 | 7/2019 | Cryer |
| 10,371,012 | B2 | 8/2019 | Davis et al. |
| 10,374,485 | B2 | 8/2019 | Morris et al. |
| 10,378,326 | B2 | 8/2019 | Morris et al. |
| 10,393,108 | B2 | 8/2019 | Chong et al. |
| 10,407,990 | B2 | 9/2019 | Oehring et al. |
| 10,408,031 | B2 | 9/2019 | Oehring et al. |
| 10,415,348 | B2 | 9/2019 | Zhang et al. |
| 10,415,557 | B1 | 9/2019 | Crowe et al. |
| 10,415,562 | B2 | 9/2019 | Kajita et al. |
| RE47,695 | E | 11/2019 | Case et al. |
| 10,465,689 | B2 | 11/2019 | Crom |
| 10,478,753 | B1 | 11/2019 | Elms et al. |
| 10,526,882 | B2 | 1/2020 | Oehring et al. |
| 10,563,649 | B2 | 2/2020 | Zhang et al. |
| 10,577,910 | B2 | 3/2020 | Stephenson |
| 10,584,645 | B2 | 3/2020 | Nakagawa et al. |
| 10,590,867 | B2 | 3/2020 | Thomassin et al. |
| 10,598,258 | B2 | 3/2020 | Oehring et al. |
| 10,610,842 | B2 | 4/2020 | Chong |
| 10,662,749 | B1 | 5/2020 | Hill et al. |
| 10,711,787 | B1 | 7/2020 | Darley |
| 10,738,580 | B1 | 8/2020 | Fischer et al. |
| 10,753,153 | B1 | 8/2020 | Fischer et al. |
| 10,753,165 | B1 | 8/2020 | Fischer et al. |
| 10,760,556 | B1 | 9/2020 | Cram et al. |
| 10,794,165 | B2 | 10/2020 | Fischer et al. |
| 10,794,166 | B2 | 10/2020 | Reckels et al. |
| 10,801,311 | B1 | 10/2020 | Cui et al. |
| 10,815,764 | B1 | 10/2020 | Yeung et al. |
| 10,815,978 | B2 | 10/2020 | Glass |
| 10,830,032 | B1 | 11/2020 | Zhang et al. |
| 10,830,225 | B2 | 11/2020 | Repaci |
| 10,859,203 | B1 | 12/2020 | Cui et al. |
| 10,864,487 | B1 | 12/2020 | Han et al. |
| 10,865,624 | B1 | 12/2020 | Cui et al. |
| 10,865,631 | B1 | 12/2020 | Zhang et al. |
| 10,870,093 | B1 | 12/2020 | Zhong et al. |
| 10,871,045 | B2 | 12/2020 | Fischer et al. |
| 10,895,202 | B1 | 1/2021 | Yeung et al. |
| 10,900,475 | B2 | 1/2021 | Weightman et al. |
| 10,907,459 | B1 | 2/2021 | Yeung et al. |
| 10,927,774 | B2 | 2/2021 | Cai et al. |
| 10,927,802 | B2 | 2/2021 | Oehring |
| 10,954,770 | B1 | 3/2021 | Yeung et al. |
| 10,954,855 | B1 | 3/2021 | Ji et al. |
| 10,961,614 | B1 | 3/2021 | Yeung et al. |
| 10,961,908 | B1 | 3/2021 | Yeung et al. |
| 10,961,912 | B1 | 3/2021 | Yeung et al. |
| 10,961,914 | B1 | 3/2021 | Yeung et al. |
| 10,961,993 | B1 | 3/2021 | Ji et al. |
| 10,961,995 | B2 | 3/2021 | Mayorca |
| 10,892,596 | B2 | 4/2021 | Yeung et al. |
| 10,968,837 | B1 | 4/2021 | Yeung et al. |
| 10,982,523 | B1 | 4/2021 | Hill et al. |
| 10,989,019 | B2 | 4/2021 | Cai et al. |
| 10,989,180 | B2 | 4/2021 | Yeung et al. |
| 10,995,564 | B2 | 5/2021 | Miller et al. |
| 11,002,189 | B2 | 5/2021 | Yeung et al. |
| 11,008,950 | B2 | 5/2021 | Ethier et al. |
| 11,015,423 | B1 | 5/2021 | Yeung et al. |
| 11,015,536 | B2 | 5/2021 | Yeung et al. |
| 11,015,594 | B2 | 5/2021 | Yeung et al. |
| 11,022,526 | B1 | 6/2021 | Yeung et al. |
| 11,028,677 | B1 | 6/2021 | Yeung et al. |
| 11,035,213 | B2 | 6/2021 | Dusterhoft et al. |
| 11,035,214 | B2 | 6/2021 | Cui et al. |
| 11,047,379 | B1 | 6/2021 | Li et al. |
| 11,053,853 | B2 | 7/2021 | Li et al. |
| 11,060,455 | B1 | 7/2021 | Yeung et al. |
| 11,068,455 | B2 | 7/2021 | Shabi et al. |
| 11,085,281 | B1 | 8/2021 | Yeung et al. |
| 11,085,282 | B2 | 8/2021 | Mazrooee et al. |
| 11,092,152 | B2 | 8/2021 | Yeung et al. |
| 11,098,651 | B1 | 8/2021 | Yeung et al. |
| 11,105,250 | B1 | 8/2021 | Zhang et al. |
| 11,105,266 | B2 | 8/2021 | Zhou et al. |
| 11,109,508 | B1 | 8/2021 | Yeung et al. |
| 11,111,768 | B1 | 9/2021 | Yeung et al. |
| 11,125,066 | B1 | 9/2021 | Yeung et al. |
| 11,125,156 | B2 | 9/2021 | Zhang et al. |
| 11,129,295 | B1 | 9/2021 | Yeung et al. |
| 11,143,000 | B2 | 10/2021 | Li et al. |
| 11,143,006 | B1 | 10/2021 | Zhang et al. |
| 11,149,533 | B1 | 10/2021 | Yeung et al. |
| 11,149,726 | B1 | 10/2021 | Yeung et al. |
| 11,156,159 | B1 | 10/2021 | Yeung et al. |
| 11,168,681 | B2 | 11/2021 | Boguski |
| 11,174,716 | B1 | 11/2021 | Yeung et al. |
| 11,193,360 | B1 | 12/2021 | Yeung et al. |
| 11,193,361 | B1 | 12/2021 | Yeung et al. |
| 11,205,880 | B1 | 12/2021 | Yeung et al. |
| 11,205,881 | B2 | 12/2021 | Yeung et al. |
| 11,208,879 | B1 | 12/2021 | Yeung et al. |
| 11,208,953 | B1 | 12/2021 | Yeung et al. |
| 11,220,895 | B1 | 1/2022 | Yeung et al. |
| 11,236,739 | B2 | 2/2022 | Yeung et al. |
| 11,242,737 | B2 | 2/2022 | Zhang et al. |
| 11,243,509 | B2 | 2/2022 | Cai et al. |
| 11,251,650 | B1 | 2/2022 | Liu et al. |
| 11,261,717 | B2 | 3/2022 | Yeung et al. |
| 11,268,346 | B2 | 3/2022 | Yeung et al. |
| 11,280,266 | B2 | 3/2022 | Yeung et al. |
| RE49,083 | E | 5/2022 | Case et al. |
| 11,339,638 | B1 | 5/2022 | Yeung et al. |
| 11,346,200 | B2 | 5/2022 | Cai et al. |
| 11,373,058 | B2 | 6/2022 | Jaaskelainen et al. |
| RE49,140 | E | 7/2022 | Case et al. |
| 11,377,943 | B2 | 7/2022 | Kriebel et al. |
| RE49,155 | E | 8/2022 | Case et al. |
| RE49,156 | E | 8/2022 | Case et al. |
| 11,401,927 | B2 | 8/2022 | Li et al. |
| 11,428,165 | B2 | 8/2022 | Yeung et al. |
| 11,441,483 | B2 | 9/2022 | Li et al. |
| 11,448,122 | B2 | 9/2022 | Feng et al. |
| 11,466,680 | B2 | 10/2022 | Yeung et al. |
| 11,480,040 | B2 | 10/2022 | Han et al. |
| 11,492,887 | B2 | 11/2022 | Cui et al. |
| 11,499,405 | B2 | 11/2022 | Zhang et al. |
| 11,506,039 | B2 | 11/2022 | Zhang et al. |
| 11,512,570 | B2 | 11/2022 | Yeung |
| 11,519,395 | B2 | 12/2022 | Zhang et al. |
| 11,519,405 | B2 | 12/2022 | Deng et al. |
| 11,530,602 | B2 | 12/2022 | Yeung et al. |
| 11,549,349 | B2 | 1/2023 | Wang et al. |
| 11,555,390 | B2 | 1/2023 | Cui et al. |
| 11,555,756 | B2 | 1/2023 | Yeung et al. |
| 11,557,887 | B2 | 1/2023 | Ji et al. |
| 11,560,779 | B2 | 1/2023 | Mao et al. |
| 11,560,845 | B2 | 1/2023 | Yeung et al. |
| 11,572,775 | B2 | 2/2023 | Mao et al. |
| 11,575,249 | B2 | 2/2023 | Ji et al. |
| 11,592,020 | B2 | 2/2023 | Chang et al. |
| 11,596,047 | B2 | 2/2023 | Liu et al. |
| 2002/0126922 | A1 | 9/2002 | Cheng et al. |
| 2002/0197176 | A1 | 12/2002 | Kondo |
| 2003/0031568 | A1 | 2/2003 | Stiefel |
| 2003/0061819 | A1 | 4/2003 | Kuroki et al. |
| 2003/0161212 | A1* | 8/2003 | Neal ..... B01F 33/502 366/27 |

(56) References Cited

U.S. PATENT DOCUMENTS

| | | | |
|---|---|---|---|
| 2004/0016245 | A1 | 1/2004 | Pierson |
| 2004/0074238 | A1 | 4/2004 | Wantanabe et al. |
| 2004/0076526 | A1 | 4/2004 | Fukano et al. |
| 2004/0187950 | A1 | 9/2004 | Cohen et al. |
| 2004/0219040 | A1 | 11/2004 | Kugelev et al. |
| 2005/0051322 | A1 | 3/2005 | Speer |
| 2005/0056081 | A1 | 3/2005 | Gocho |
| 2005/0139286 | A1 | 6/2005 | Poulter |
| 2005/0196298 | A1 | 9/2005 | Manning |
| 2005/0226754 | A1 | 10/2005 | Orr et al. |
| 2005/0274134 | A1 | 12/2005 | Ryu et al. |
| 2006/0061091 | A1 | 3/2006 | Osterloh |
| 2006/0062914 | A1 | 3/2006 | Garg et al. |
| 2006/0196251 | A1 | 9/2006 | Richey |
| 2006/0211356 | A1 | 9/2006 | Grassman |
| 2006/0228225 | A1 | 10/2006 | Rogers |
| 2006/0260331 | A1 | 11/2006 | Andreychuk |
| 2006/0272333 | A1 | 12/2006 | Sundin |
| 2007/0029090 | A1 | 2/2007 | Andreychuk et al. |
| 2007/0041848 | A1 | 2/2007 | Wood et al. |
| 2007/0066406 | A1 | 3/2007 | Keller et al. |
| 2007/0098580 | A1 | 5/2007 | Petersen |
| 2007/0107981 | A1 | 5/2007 | Sicotte |
| 2007/0125544 | A1 | 6/2007 | Robinson et al. |
| 2007/0169543 | A1 | 7/2007 | Fazekas |
| 2007/0181212 | A1 | 8/2007 | Fell |
| 2007/0277982 | A1 | 12/2007 | Shampine et al. |
| 2007/0295569 | A1 | 12/2007 | Manzoor et al. |
| 2008/0006089 | A1 | 1/2008 | Adnan et al. |
| 2008/0098891 | A1 | 5/2008 | Feher |
| 2008/0161974 | A1 | 7/2008 | Alston |
| 2008/0212275 | A1 | 9/2008 | Waryck et al. |
| 2008/0229757 | A1 | 9/2008 | Alexander et al. |
| 2008/0264625 | A1 | 10/2008 | Ochoa |
| 2008/0264649 | A1 | 10/2008 | Crawford |
| 2008/0298982 | A1 | 12/2008 | Pabst |
| 2009/0064685 | A1 | 3/2009 | Busekros et al. |
| 2009/0068031 | A1 | 3/2009 | Gambier et al. |
| 2009/0092510 | A1 | 4/2009 | Williams et al. |
| 2009/0124191 | A1 | 5/2009 | Van Becelaere et al. |
| 2009/0178412 | A1 | 7/2009 | Spytek |
| 2009/0212630 | A1 | 8/2009 | Flegel et al. |
| 2009/0249794 | A1 | 10/2009 | Wilkes et al. |
| 2009/0252616 | A1 | 10/2009 | Brunet et al. |
| 2009/0308602 | A1 | 12/2009 | Bruins et al. |
| 2010/0019626 | A1 | 1/2010 | Stout et al. |
| 2010/0071899 | A1 | 3/2010 | Coquilleau et al. |
| 2010/0218508 | A1 | 9/2010 | Brown et al. |
| 2010/0300683 | A1 | 12/2010 | Looper et al. |
| 2010/0310384 | A1 | 12/2010 | Stephenson et al. |
| 2011/0041681 | A1 | 2/2011 | Duerr |
| 2011/0052423 | A1 | 3/2011 | Gambier et al. |
| 2011/0054704 | A1 | 3/2011 | Karpman et al. |
| 2011/0085924 | A1 | 4/2011 | Shampine et al. |
| 2011/0146244 | A1 | 6/2011 | Farman et al. |
| 2011/0146246 | A1 | 6/2011 | Farman et al. |
| 2011/0173991 | A1 | 7/2011 | Dean |
| 2011/0197988 | A1 | 8/2011 | Van Vliet et al. |
| 2011/0241888 | A1 | 10/2011 | Lu et al. |
| 2011/0265443 | A1 | 11/2011 | Ansari |
| 2011/0272158 | A1 | 11/2011 | Neal |
| 2012/0023973 | A1 | 2/2012 | Mayorca |
| 2012/0048242 | A1 | 3/2012 | Surnilla et al. |
| 2012/0085541 | A1 | 4/2012 | Love et al. |
| 2012/0137699 | A1 | 6/2012 | Montagne et al. |
| 2012/0179444 | A1 | 7/2012 | Ganguly et al. |
| 2012/0192542 | A1 | 8/2012 | Chillar et al. |
| 2012/0199001 | A1 | 8/2012 | Chillar et al. |
| 2012/0204627 | A1 | 8/2012 | Anderl et al. |
| 2012/0255734 | A1 | 10/2012 | Coli et al. |
| 2012/0310509 | A1 | 12/2012 | Pardo et al. |
| 2012/0324903 | A1 | 12/2012 | Dewis et al. |
| 2013/0068307 | A1 | 3/2013 | Hains et al. |
| 2013/0087045 | A1 | 4/2013 | Sullivan et al. |
| 2013/0087945 | A1 | 4/2013 | Kusters et al. |
| 2013/0134702 | A1 | 5/2013 | Boraas et al. |
| 2013/0189915 | A1 | 7/2013 | Hazard |
| 2013/0233165 | A1 | 9/2013 | Matzner et al. |
| 2013/0255953 | A1 | 10/2013 | Tudor |
| 2013/0259707 | A1 | 10/2013 | Yin |
| 2013/0284455 | A1 | 10/2013 | Kajaria et al. |
| 2013/0300341 | A1 | 11/2013 | Gillette |
| 2013/0306322 | A1 | 11/2013 | Sanborn |
| 2014/0010671 | A1 | 1/2014 | Cryer et al. |
| 2014/0013768 | A1 | 1/2014 | Laing et al. |
| 2014/0032082 | A1 | 1/2014 | Gehrke et al. |
| 2014/0044517 | A1 | 2/2014 | Saha et al. |
| 2014/0048253 | A1 | 2/2014 | Andreychuk |
| 2014/0090729 | A1 | 4/2014 | Coulter et al. |
| 2014/0090742 | A1 | 4/2014 | Coskrey et al. |
| 2014/0094105 | A1 | 4/2014 | Lundh et al. |
| 2014/0095114 | A1 | 4/2014 | Thomeer et al. |
| 2014/0095554 | A1 | 4/2014 | Thomeer et al. |
| 2014/0123621 | A1 | 5/2014 | Driessens et al. |
| 2014/0130422 | A1 | 5/2014 | Laing et al. |
| 2014/0138079 | A1 | 5/2014 | Broussard et al. |
| 2014/0144641 | A1 | 5/2014 | Chandler |
| 2014/0147291 | A1 | 5/2014 | Burnette |
| 2014/0158345 | A1 | 6/2014 | Jang et al. |
| 2014/0196459 | A1 | 7/2014 | Futa et al. |
| 2014/0216736 | A1 | 8/2014 | Leugemors et al. |
| 2014/0219824 | A1 | 8/2014 | Burnette |
| 2014/0250845 | A1 | 9/2014 | Jackson et al. |
| 2014/0251623 | A1 | 9/2014 | Lestz et al. |
| 2014/0277772 | A1 | 9/2014 | Lopez et al. |
| 2014/0290266 | A1 | 10/2014 | Veilleux, Jr. et al. |
| 2014/0318638 | A1 | 10/2014 | Harwood et al. |
| 2014/0322050 | A1 | 10/2014 | Marette et al. |
| 2015/0027730 | A1 | 1/2015 | Hall et al. |
| 2015/0078924 | A1 | 3/2015 | Zhang et al. |
| 2015/0101344 | A1 | 4/2015 | Jarrier et al. |
| 2015/0114652 | A1 | 4/2015 | Lestz et al. |
| 2015/0129210 | A1 | 5/2015 | Chong et al. |
| 2015/0135659 | A1 | 5/2015 | Jarrier et al. |
| 2015/0159553 | A1 | 6/2015 | Kippel et al. |
| 2015/0192117 | A1 | 7/2015 | Bridges |
| 2015/0204148 | A1 | 7/2015 | Liu et al. |
| 2015/0204322 | A1 | 7/2015 | Iund et al. |
| 2015/0211512 | A1 | 7/2015 | Wiegman et al. |
| 2015/0214816 | A1 | 7/2015 | Raad |
| 2015/0217672 | A1 | 8/2015 | Shampine et al. |
| 2015/0226140 | A1 | 8/2015 | Zhang et al. |
| 2015/0252661 | A1 | 9/2015 | Glass |
| 2015/0275891 | A1 | 10/2015 | Chong et al. |
| 2015/0337730 | A1 | 11/2015 | Kupiszewski et al. |
| 2015/0340864 | A1 | 11/2015 | Compton |
| 2015/0345385 | A1 | 12/2015 | Santini |
| 2015/0369351 | A1 | 12/2015 | Hermann et al. |
| 2016/0032703 | A1 | 2/2016 | Broussard et al. |
| 2016/0032836 | A1 | 2/2016 | Hawkinson et al. |
| 2016/0076447 | A1 | 3/2016 | Merlo et al. |
| 2016/0102581 | A1 | 4/2016 | Del Bono |
| 2016/0105022 | A1 | 4/2016 | Oehring et al. |
| 2016/0108713 | A1 | 4/2016 | Dunaeva et al. |
| 2016/0168979 | A1 | 6/2016 | Zhang et al. |
| 2016/0177675 | A1 | 6/2016 | Morris et al. |
| 2016/0177945 | A1 | 6/2016 | Byrne et al. |
| 2016/0186671 | A1 | 6/2016 | Austin et al. |
| 2016/0195082 | A1 | 7/2016 | Wiegman et al. |
| 2016/0215774 | A1 | 7/2016 | Oklejas et al. |
| 2016/0230525 | A1 | 8/2016 | Lestz et al. |
| 2016/0244314 | A1 | 8/2016 | Van Vliet et al. |
| 2016/0248230 | A1 | 8/2016 | Tawy et al. |
| 2016/0253634 | A1 | 9/2016 | Thomeer et al. |
| 2016/0258267 | A1 | 9/2016 | Payne et al. |
| 2016/0273328 | A1 | 9/2016 | Oehring |
| 2016/0273346 | A1 | 9/2016 | Tang et al. |
| 2016/0290114 | A1 | 10/2016 | Oehring et al. |
| 2016/0319650 | A1 | 11/2016 | Oehring et al. |
| 2016/0326845 | A1 | 11/2016 | Djikpesse et al. |
| 2016/0348479 | A1 | 12/2016 | Oehring et al. |
| 2016/0369609 | A1 | 12/2016 | Morris et al. |
| 2017/0009905 | A1 | 1/2017 | Arnold |
| 2017/0016433 | A1 | 1/2017 | Chong et al. |

(56) References Cited

U.S. PATENT DOCUMENTS

2017/0030177 A1 2/2017 Oehring et al.
2017/0038137 A1 2/2017 Turney
2017/0045055 A1 2/2017 Hoefel et al.
2017/0052087 A1 2/2017 Faqihi et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladron de Guevara
2017/0131174 A1 5/2017 Enev et al.
2017/0145918 A1 5/2017 Oehring et al.
2017/0191350 A1 7/2017 Johns et al.
2017/0218727 A1 8/2017 Oehring et al.
2017/0226839 A1 8/2017 Broussard et al.
2017/0226842 A1 8/2017 Omont et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0248034 A1 8/2017 Dzieciol et al.
2017/0248208 A1 8/2017 Tamura
2017/0248308 A1 8/2017 Makarychev-Mikhailov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1 10/2017 Dole
2017/0322086 A1 11/2017 Luharuka
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0370199 A1 12/2017 Witkowski et al.
2017/0370480 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0087499 A1 3/2018 Zhang et al.
2018/0087996 A1 3/2018 De La Cruz
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1 10/2018 Bishop
2018/0298735 A1 10/2018 Conrad
2018/0307255 A1 10/2018 Bishop
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.
2019/0063263 A1 2/2019 Davis et al.
2019/0063341 A1 2/2019 Davis
2019/0067991 A1 2/2019 Davis et al.
2019/0071992 A1 3/2019 Feng
2019/0072005 A1 3/2019 Fisher et al.
2019/0078471 A1 3/2019 Braglia et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1 5/2019 Shampine et al.
2019/0153843 A1 5/2019 Headrick et al.
2019/0153938 A1 5/2019 Hammoud
2019/0154020 A1 5/2019 Glass
2019/0155318 A1 5/2019 Meunier
2019/0264667 A1 5/2019 Byrne
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckies et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0277279 A1 9/2019 Byrne et al.
2019/0277295 A1 9/2019 Clyburn et al.
2019/0309585 A1 10/2019 Miller et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0337392 A1 11/2019 Joshi et al.
2019/0338762 A1 11/2019 Curry et al.
2019/0345920 A1 11/2019 Suijaatmadja et al.
2019/0353103 A1 11/2019 Roberge
2019/0356199 A1 11/2019 Morris et al.
2019/0376449 A1 12/2019 Carrell
2019/0383123 A1 12/2019 Hinderliter
2020/0003205 A1 1/2020 Stokkevåg et al.
2020/0011165 A1 1/2020 George et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0072201 A1 3/2020 Marica
2020/0088202 A1 3/2020 Sigmar et al.
2020/0095854 A1 3/2020 Hinderliter
2020/0109610 A1 4/2020 Husoy et al.
2020/0132058 A1 4/2020 Mollatt
2020/0141219 A1 5/2020 Oehring et al.
2020/0141326 A1 5/2020 Redford et al.
2020/0141907 A1 5/2020 Meek et al.
2020/0166026 A1 5/2020 Marica
2020/0206704 A1 7/2020 Chong
2020/0208733 A1 7/2020 Kim
2020/0223648 A1 7/2020 Herman et al.
2020/0224645 A1 7/2020 Buckley
2020/0232454 A1 7/2020 Chretien et al.
2020/0256333 A1 8/2020 Suijaatmadja

(56) References Cited

U.S. PATENT DOCUMENTS

2020/0263498 A1 8/2020 Fischer et al.
2020/0263525 A1 8/2020 Reid
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0291731 A1 9/2020 Haiderer et al.
2020/0295574 A1 9/2020 Batsch-Smith
2020/0300050 A1 9/2020 Oehring et al.
2020/0309113 A1 10/2020 Hunter et al.
2020/0325752 A1 10/2020 Clark et al.
2020/0325760 A1 10/2020 Markham
2020/0325761 A1 10/2020 Williams
2020/0325893 A1 10/2020 Kraige et al.
2020/0332784 A1 10/2020 Zhang et al.
2020/0332788 A1 10/2020 Cui et al.
2020/0340313 A1 10/2020 Fischer et al.
2020/0340340 A1 10/2020 Oehring et al.
2020/0340344 A1 10/2020 Reckels et al.
2020/0340404 A1 10/2020 Stockstill
2020/0347725 A1 11/2020 Morris et al.
2020/0354928 A1 11/2020 Wehler et al.
2020/0362760 A1 11/2020 Morenko et al.
2020/0362764 A1 11/2020 Saintignan et al.
2020/0370394 A1 11/2020 Cai et al.
2020/0370408 A1 11/2020 Cai et al.
2020/0370429 A1 11/2020 Cai et al.
2020/0371490 A1 11/2020 Cai et al.
2020/0340322 A1 12/2020 Sizemore et al.
2020/0386222 A1 12/2020 Pham et al.
2020/0388140 A1 12/2020 Gomez et al.
2020/0392826 A1 12/2020 Cui et al.
2020/0392827 A1 12/2020 George et al.
2020/0393088 A1 12/2020 Sizemore et al.
2020/0398238 A1 12/2020 Zhong et al.
2020/0400000 A1 12/2020 Ghasripoor et al.
2020/0400005 A1 12/2020 Han et al.
2020/0407625 A1 12/2020 Stephenson
2020/0408071 A1 12/2020 Li et al.
2020/0408144 A1 12/2020 Feng et al.
2020/0408147 A1 12/2020 Zhang et al.
2020/0408149 A1 12/2020 Li et al.
2021/0025324 A1 1/2021 Morris et al.
2021/0025383 A1 1/2021 Bodishbaugh et al.
2021/0032961 A1 2/2021 Hinderliter et al.
2021/0054727 A1 2/2021 Floyd
2021/0071503 A1 3/2021 Ogg et al.
2021/0071574 A1 3/2021 Feng et al.
2021/0071579 A1 3/2021 Li et al.
2021/0071654 A1 3/2021 Brunson
2021/0071752 A1 3/2021 Cui et al.
2021/0079758 A1 3/2021 Yeung et al.
2021/0079851 A1 3/2021 Yeung et al.
2021/0086851 A1 3/2021 Zhang et al.
2021/0087883 A1 3/2021 Zhang et al.
2021/0087916 A1 3/2021 Zhang et al.
2021/0087925 A1 3/2021 Heidari et al.
2021/0087943 A1 3/2021 Cui et al.
2021/0088042 A1 3/2021 Zhang et al.
2021/0123425 A1 4/2021 Cui et al.
2021/0123434 A1 4/2021 Cui et al.
2021/0123435 A1 4/2021 Cui et al.
2021/0131409 A1 5/2021 Cui et al.
2021/0140416 A1 5/2021 Buckley
2021/0148208 A1 5/2021 Thomas et al.
2021/0156240 A1 5/2021 Cicci et al.
2021/0156241 A1 5/2021 Cook
2021/0172282 A1 6/2021 Wang et al.
2021/0180517 A1 6/2021 Zhou et al.
2021/0199110 A1 7/2021 Albert et al.
2021/0222690 A1 7/2021 Beisel
2021/0239112 A1 8/2021 Buckley
2021/0246774 A1 8/2021 Cui et al.
2021/0270261 A1* 9/2021 Zhang ..... F04B 53/18
2021/0270264 A1 9/2021 Byrne
2021/0285311 A1 9/2021 Ji et al.
2021/0285432 A1 9/2021 Ji et al.
2021/0301807 A1 9/2021 Cui et al.
2021/0306720 A1 9/2021 Sandoval et al.
2021/0308638 A1 10/2021 Zhong et al.
2021/0348475 A1 11/2021 Yeung et al.
2021/0348476 A1 11/2021 Yeung et al.
2021/0348477 A1 11/2021 Yeung et al.
2021/0355927 A1 11/2021 Jian et al.
2021/0372394 A1 12/2021 Bagulayan et al.
2021/0372395 A1 12/2021 Li et al.
2021/0388760 A1 12/2021 Feng et al.
2022/0082007 A1 3/2022 Zhang et al.
2022/0090476 A1 3/2022 Zhang et al.
2022/0090477 A1 3/2022 Zhang et al.
2022/0090478 A1 3/2022 Zhang et al.
2022/0112892 A1 4/2022 Cui et al.
2022/0120262 A1 4/2022 Ji et al.
2022/0145740 A1 5/2022 Yuan et al.
2022/0154775 A1 5/2022 Liu et al.
2022/0155373 A1 5/2022 Liu et al.
2022/0162931 A1 5/2022 Zhong et al.
2022/0162991 A1 5/2022 Zhang et al.
2022/0181859 A1 6/2022 Ji et al.
2022/0186724 A1 6/2022 Chang et al.
2022/0213777 A1 7/2022 Cui et al.
2022/0220836 A1 7/2022 Zhang et al.
2022/0224087 A1 7/2022 Ji et al.
2022/0228468 A1 7/2022 Cui et al.
2022/0228469 A1 7/2022 Zhang et al.
2022/0235639 A1 7/2022 Zhang et al.
2022/0235640 A1 7/2022 Mao et al.
2022/0235641 A1 7/2022 Zhang et al.
2022/0235642 A1 7/2022 Zhang et al.
2022/0235802 A1 7/2022 Jiang et al.
2022/0242297 A1 8/2022 Tian et al.
2022/0243613 A1 8/2022 Ji et al.
2022/0243724 A1 8/2022 Li et al.
2022/0250000 A1 8/2022 Zhang et al.
2022/0255319 A1 8/2022 Liu et al.
2022/0258659 A1 8/2022 Cui et al.
2022/0259947 A1 8/2022 Li et al.
2022/0259964 A1 8/2022 Zhang et al.
2022/0268201 A1 8/2022 Feng et al.
2022/0282606 A1 9/2022 Zhong et al.
2022/0282726 A1 9/2022 Zhang et al.
2022/0290549 A1 9/2022 Zhang et al.
2022/0294194 A1 9/2022 Cao et al.
2022/0298906 A1 9/2022 Zhong et al.
2022/0307359 A1 9/2022 Liu et al.
2022/0307424 A1 9/2022 Wang et al.
2022/0314248 A1 10/2022 Ge et al.
2022/0315347 A1 10/2022 Liu et al.
2022/0316306 A1 10/2022 Liu et al.
2022/0316362 A1 10/2022 Zhang et al.
2022/0316461 A1 10/2022 Wang et al.
2022/0325608 A1 10/2022 Zhang et al.
2022/0330411 A1 10/2022 Liu et al.
2022/0333471 A1 10/2022 Zhong et al.
2022/0339646 A1 10/2022 Yu et al.
2022/0341358 A1 10/2022 Ji et al.
2022/0341362 A1 10/2022 Feng et al.
2022/0341415 A1 10/2022 Deng et al.
2022/0345007 A1 10/2022 Liu et al.
2022/0349345 A1 11/2022 Zhang et al.
2022/0353980 A1 11/2022 Liu et al.
2022/0361309 A1 11/2022 Liu et al.
2022/0364452 A1 11/2022 Wang et al.
2022/0364453 A1 11/2022 Chang et al.
2022/0372865 A1 11/2022 Lin et al.
2022/0376280 A1 11/2022 Shao et al.
2022/0381126 A1 12/2022 Cui et al.
2022/0389799 A1 12/2022 Mao
2022/0389803 A1 12/2022 Zhang et al.
2022/0389804 A1 12/2022 Cui et al.
2022/0389865 A1 12/2022 Feng et al.
2022/0389867 A1 12/2022 Li et al.
2022/0412196 A1 12/2022 Cui et al.
2022/0412199 A1 12/2022 Mao et al.

(56) References Cited

U.S. PATENT DOCUMENTS

| | | | |
|---|---|---|---|
| 2022/0412200 | A1 | 12/2022 | Zhang et al. |
| 2022/0412258 | A1 | 12/2022 | Li et al. |
| 2022/0412379 | A1 | 12/2022 | Wang et al. |
| 2023/0001524 | A1 | 1/2023 | Jiang et al. |
| 2023/0003238 | A1 | 1/2023 | Du et al. |
| 2023/0015132 | A1 | 1/2023 | Feng et al. |
| 2023/0015529 | A1 | 1/2023 | Zhang et al. |
| 2023/0015581 | A1 | 1/2023 | Ji et al. |
| 2023/0017968 | A1 | 1/2023 | Deng et al. |
| 2023/0029574 | A1 | 2/2023 | Zhang et al. |
| 2023/0029671 | A1 | 2/2023 | Han et al. |
| 2023/0036118 | A1 | 2/2023 | Xing et al. |
| 2023/0040970 | A1 | 2/2023 | Liu et al. |
| 2023/0042379 | A1 | 2/2023 | Zhang et al. |
| 2023/0047033 | A1 | 2/2023 | Fu et al. |
| 2023/0048551 | A1 | 2/2023 | Feng et al. |
| 2023/0049462 | A1 | 2/2023 | Zhang et al. |
| 2023/0064964 | A1 | 3/2023 | Wang et al. |
| 2023/0074794 | A1 | 3/2023 | Liu et al. |

FOREIGN PATENT DOCUMENTS

| | | | |
|---|---|---|---|
| CA | 2043184 | | 8/1994 |
| CA | 2829762 | | 9/2012 |
| CA | 2737321 | | 9/2013 |
| CA | 2876687 | A1 | 5/2014 |
| CA | 2693567 | | 9/2014 |
| CA | 2964597 | | 10/2017 |
| CA | 2876687 | C | 4/2019 |
| CA | 3138533 | | 11/2020 |
| CA | 2919175 | | 3/2021 |
| CN | 2622404 | | 6/2004 |
| CN | 2779054 | | 5/2006 |
| CN | 2890325 | | 4/2007 |
| CN | 200964929 | Y | 10/2007 |
| CN | 101323151 | A | 12/2008 |
| CN | 201190660 | Y | 2/2009 |
| CN | 201190892 | Y | 2/2009 |
| CN | 201190893 | Y | 2/2009 |
| CN | 101414171 | A | 4/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | | 1/2011 |
| CN | 201756927 | U | 3/2011 |
| CN | 101414171 | B | 5/2011 |
| CN | 102128011 | A | 7/2011 |
| CN | 102140898 | A | 8/2011 |
| CN | 102155172 | A | 8/2011 |
| CN | 102182904 | | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |

(56) References Cited

FOREIGN PATENT DOCUMENTS

| | | | |
|---|---|---|---|
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |

(56) References Cited

FOREIGN PATENT DOCUMENTS

| | | | |
|---|---|---|---|
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108799473 | | 11/2018 |
| CN | 108868675 | A | 11/2018 |
| CN | 208086829 | | 11/2018 |
| CN | 208089263 | | 11/2018 |
| CN | 208169068 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208253147 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |

(56) References Cited

FOREIGN PATENT DOCUMENTS

| | | | |
|---|---|---|---|
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | | 2/2020 |
| CN | 210049882 | | 2/2020 |
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4004854 | | 8/1991 |
| DE | 4241614 | | 6/1994 |
| DE | 102009022859 | | 12/2010 |
| DE | 102012018825 | | 3/2014 |
| DE | 102013111655 | | 12/2014 |
| DE | 102015103872 | | 10/2015 |
| DE | 102013114335 | | 12/2020 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |
| EP | 3211766 | | 8/2017 |
| EP | 3049642 | | 4/2018 |
| EP | 3354866 | | 8/2018 |
| EP | 3075946 | | 5/2019 |
| FR | 2795774 | | 6/1999 |
| GB | 474072 | | 10/1937 |
| GB | 1438172 | | 6/1976 |
| JP | S57135212 | | 2/1984 |
| KR | 20020026398 | | 4/2002 |
| RU | 13562 | | 4/2000 |
| WO | 1993020328 | | 10/1993 |
| WO | 2006025886 | | 3/2006 |
| WO | 2009023042 | | 2/2009 |
| WO | 20110133821 | | 10/2011 |
| WO | 2012139380 | | 10/2012 |
| WO | 2013158822 | | 10/2013 |
| WO | PCT/CN2012/074945 | | 11/2013 |
| WO | 2013185399 | | 12/2013 |
| WO | 2015158020 | | 10/2015 |
| WO | 2016014476 | | 1/2016 |
| WO | 2016033983 | | 3/2016 |
| WO | 2016078181 | | 5/2016 |
| WO | 2016101374 | | 6/2016 |
| WO | 2016112590 | | 7/2016 |
| WO | 2017123656 | A | 7/2017 |
| WO | 2017146279 | | 8/2017 |
| WO | 2017213848 | | 12/2017 |
| WO | 2018031029 | | 2/2018 |
| WO | 2018038710 | | 3/2018 |
| WO | 2018044293 | | 3/2018 |
| WO | 2018044307 | | 3/2018 |
| WO | 2018071738 | | 4/2018 |
| WO | 2018101909 | | 6/2018 |
| WO | 2018101912 | | 6/2018 |

(56) References Cited

FOREIGN PATENT DOCUMENTS

| | | |
|---|---|---|
| WO | 2018106210 | 6/2018 |
| WO | 2018106225 | 6/2018 |
| WO | 2018106252 | 6/2018 |
| WO | 2018/132106 | 7/2018 |
| WO | 2018156131 | 8/2018 |
| WO | 2018075034 | 10/2018 |
| WO | 2018187346 | 10/2018 |
| WO | 2018031031 | 2/2019 |
| WO | 2019045691 | 3/2019 |
| WO | 2019046680 | 3/2019 |
| WO | 2019060922 | 3/2019 |
| WO | 2019117862 | 6/2019 |
| WO | 2019126742 | 6/2019 |
| WO | 2019147601 | 8/2019 |
| WO | 2019169366 | 9/2019 |
| WO | 2019195651 | 10/2019 |
| WO | 2019200510 | 10/2019 |
| WO | 2019210417 | 11/2019 |
| WO | 2020018068 | 1/2020 |
| WO | 2020046866 | 3/2020 |
| WO | 2020072076 | 4/2020 |
| WO | 2020076569 | 4/2020 |
| WO | 2020097060 | 5/2020 |
| WO | 2020104088 | 5/2020 |
| WO | 2020131085 | 6/2020 |
| WO | 2020211083 | 10/2020 |
| WO | 2020211086 | 10/2020 |
| WO | 2021/038604 | 3/2021 |
| WO | 2021038604 | 3/2021 |
| WO | 2021041783 | 3/2021 |

OTHER PUBLICATIONS

US 11,555,493 B2, 01/2023, Chang et al. (withdrawn)

Rigmaster Machinery Ltd., Model: 2000 RMP-6-PLEX, brochure, downloaded at https://www.rigmastermachinery.com/_files/ugd/431e62_eaecd77c9fe54af8b13d08396072da67.pdf.

Europump and Hydraulic Institute, Variable Speed Pumping: A Guide to Successful Applications, Elsevier Ltd, 2004.

Capstone Turbine Corporation, Capstone Receives Three Megawatt Order from Large Independent Oil & Gas Company in Eagle Ford Shale Play, Dec. 7, 2010.

Wikipedia, Westinghouse Combustion Turbine Systems Division, https://en.wikipedia.org/wiki/Westinghouse_Combustion_Turbine_Systems_Division, circa 1960.

Wikipedia,Union Pacific GTELs, https://en.wikipedia.org/wiki/Union_Pacific_GTELs, circa 1950.

HCI JET Frac, Screenshots from YouTube, Dec. 11, 2010. https://www.youtube.com/watch?v=6HjXkdbFaFQ.

AFD Petroleum Ltd., Automated Hot Zone, Frac Refueling System, Dec. 2018.

Eygun, Christiane, et al., URTeC: 2687987, Mitigating Shale Gas Developments Carbon Footprint: Evaluating and Implementing Solutions in Argentina, Copyright 2017, Unconventional Resources Technology Conference.

Walzel, Brian, Hart Energy, Oil, Gas Industry Discovers Innovative Solutions to Environmental Concerns, Dec. 10, 2018.

Frac Shack, Bi-Fuel FracFueller brochure, 2011.

Pettigrew, Dana, et al., High Pressure Multi-Stage Centrifugal Pump for 10,000 psi Frac Pump—HPHPS Frac Pump, Copyright 2013, Society of Petroleum Engineers, SPE 166191.

Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.

Wallace, E.M., Associated Shale Gas: From Flares to Rig Power, Copyright 2015, Society of Petroleum Engineers, SPE-173491-MS.

Williams, C.W. (Gulf Oil Corp. Odessa Texas), The Use of Gas-turbine Engines in an Automated High-Pressure Water-injection Stations; American Petroleum Institute; API-63-144 (Jan. 1, 1963).

Neal, J.C. (Gulf Oil Corp. Odessa Texas), Gas Turbine Driven Centrifugal Pumps for High Pressure Water Injection American Institute of Mining, Metallurgical and Petroleum Engineers, Inc.; SPE-1888 (1967).

Porter, John A. (Solar Division International Harvester Co.), Modern Industrial Gas Turbines for the Oil Field; American Petroleum Institute; Drilling and Production Practice; API-67-243 (Jan. 1, 1967).

Cooper et al., Jet Frac Porta-Skid—A New Concept in Oil Field Service Pump Equipments[sic]; Halliburton Services SPE-2706 (1969).

Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).

Kas'yanov et al., Application of gas-turbine engines in pumping units complexes of hydraulic fracturing of oil and gas reservoirs; Exposition Oil & Gas; (Oct. 2012) (published in Russian).

American Petroleum Institute. API 674: Positive Displacement Pumps—Reciprocating. 3rd ed. Washington, DC: API Publishing Services, 2010.

American Petroleum Institute. API 616: Gas Turbines for the Petroleum, Chemical, and Gas Industry Services. 5th ed. Washington, DC: API Publishing Services, 2011.

Karassik, Igor, Joseph Messina, Paul Cooper, and Charles Heald. Pump Handbook. 4th ed. New York: McGraw-Hill Education, 2008.

Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-general.pdf.

The Weir Group, Inc. Weir SPM Pump Product Catalog. Ft. Worth, TX: S.P.M. Flow Control, Inc. Oct. 30, 2017. https://manage.global.weir/assets/files/product%20brochures/SPM_2P140706_Pump_Product_Catalogue_View.pdf.

Shandong Saigao Group Corporation. Q4 (5W115) Quintuplex Plunger Pump. Jinan City, Shandong Province, China: Saigao. Oct. 20, 2014. https://www.saigaogroup.com/product/q400-5w115-quintuplex-plunger-pump.html.

Marine Turbine. Turbine Powered Frac Units. Franklin, Louisiana: Marine Turbine Technologies, 2020.

Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q700.pdf, 2021.

CanDyne Pump Services, Inc. Weatherford Q700 Pump. Calgary, Alberta, Canada: CanDyne Pump Services. Aug. 15, 2015. http://candyne.com/wp-content/uploads/2014/10/181905-94921.q700-quintuplex-pump.pdf.

Arop, Julius Bankong. Geomechanical review of hydraulic fracturing technology. Thesis (M. Eng.). Cambridge, MA: Massachusetts Institute of Technology, Dept. of Civil and Environmental Engineering. Oct. 29, 2013. https://dspace.mit.edu/handle/1721.1/82176.

ResearchGate, Answer by Byron Woolridge, found at https://www.researchgate.net/post/How_can_we_improve_the_efficiency_of_the_gas_turbine_cycles, Jan. 1, 2013.

Filipović, Ivan, Preliminary Selection of Basic Parameters of Different Torsional Vibration Dampers Intended for use in Medium-Speed Diesel Engines, Transactions of Famena XXXVI-3 (2012).

Marine Turbine Technologies, 1 MW Power Generation Package, http://marineturbine.com/power-generation, 2017.

Business Week: Fiber-optic cables help fracking, cablinginstall.com. Jul. 12, 2013. https://www.cablinginstall.com/cable/article/16474208/businessweek-fiberoptic-cables-help-fracking.

Fracking companies switch to electric motors to power pumps, iadd-intl.org. Jun. 27, 2019. https://www.iadd-intl.org/articles/fracking-companies-switch-to-electric-motors-to-power-pumps/.

The Leader in Frac Fueling, suncoastresources.com. Jun. 29, 2015. https://web.archive.org/web/20150629220609/https://www.suncoastresources.com/oilfield/fueling-services/.

Mobile Fuel Delivery, atlasoil.com. Mar. 6, 2019. https://www.atlasoil.com/nationwide-fueling/onsite-and-mobile-fueling.

(56) References Cited

OTHER PUBLICATIONS

Frac Tank Hose (FRAC), 4starhose.com. Accessed: Nov. 10, 2019. http://www.4starhose.com/product/frac_tank_hose_frac.aspx.
PLOS ONE, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
Pbng, Natural Gas Fuel for Drilling and Hydraulic Fracturing, Diesel Displacement / Dual Fuel & Bi-Fuel, May 2014.
Ntegrated Flow, Skid-mounted Modular Process Systems, Jul. 15, 2017, https://ifsolutions.com/why-modular/.
Dameron, A Schlumberger Company, Frac Manifold Systems, 2016.
ZSi-Foster, Energy | Solar | Fracking | Oil and Gas, Aug. 2020, https://www.zsi-foster.com/energy-solar-fracking-oil-and-gas.html.
JBG Enterprises, Inc., WS-Series Blowout Prevention Safety Coupling—Quick Release Couplings, Sep. 11, 2015, http://www.jgbhose.com/products/WS-Series-Blowout-Prevention-Sarety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., Electric Power Generation Potential Based on Waste Heat and Geothermal Resources in South Africa, pangea.Stanford.edu (Feb. 11, 2019).
Department of Energy, United States of America, The Water-Energy Nexus: Challenges and Opportunities ourenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia, Nov. 3, 2012.
Blago Minovski, Coupled Simulations of Cooling and Engine Systems for Unsteady Analysis of the Benefits of Thermal Engine Encapsulation, Department of Applied Mechanics, Chalmers University of Technology Göteborg, Sweden 2015.
J. Porteiro et al., Feasibility of a new domestic CHP trigeneration with heat pump: II. Availability analysis. Design and development, Applied Thermal Engineering 24 (2004) 1421-1429.
ISM, What is Cracking Pressure, 2019.
Swagelok, The right valve for controlling flow direction? Check, 2016.
Technology.org, Check valves how do they work and what are the main type, 2018.
AFGlobal Corporation, Durastim Hydraulic Fracturing Pump, A Revolutionary Design for Continuous Duty Hydraulic Fracturing, 2018.
SPM® QEM 5000 E-Frac Pump Specification Sheet, Weir Group (2019) ("Weir 5000").
Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").
Dowell B908 "Turbo-Jet" Operator's Manual.
Jereh Debut's Super power Turbine Fracturing Pump, Leading the Industrial Revolution, Jereh Oilfield Services Group (Mar. 19, 2014), https://www.prnewswire.com/news-releases/jereh-debuts-super-power-turbine-fracturing-pump-leading-the-industrial-revolution-250992111.html.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www. prnewswire.com/news-releases/jereh-apollo-4500-turbine-frac-pumper-finishes-successful-field-operation-in-china-300035829.html.
35% Economy Increase, Dual-fuel System Highlighting Jereh Apollo Frac Pumper, Jereh Group (Apr. 13, 2015), https://www.jereh.com/en/news/press-release/news-detail-7345.htm.
Hydraulic Fracturing: Gas turbine proves successful in shale gasfield operations, Vericor (2017), https://www.vericor.com/wp-content/uploads/2020/02/7.-Fracing-4500hp-Pump-China-En.pdf ("Vericor Case Study").
Jereh Apollo Turbine Fracturing Pumper Featured on China Central Television, Jereh Group (Mar. 9, 2018), https://www.jereh.com/en/news/press-release/news-detail-7267.htm.
Jereh Unveiled New Electric Fracturing Solution at OTC 2019, Jereh Group (May 7, 2019), as available on May 28, 2019, https://web.archive.org/web/20190528183906/https://www.prnewswire .com/news-releases/jereh-unveiled-new-electric-fracturing-solution-at-otc-2019-300845028.html.
Jereh Group, Jereh Fracturing Unit, Fracturing Spread, YouTube (Mar. 30, 2015), https://www.youtube.com/watch?v=PIkDbU5dE0o.
Transcript of Jereh Group, Jereh Fracturing Unit, Fracturing Spread, YouTube (Mar. 30, 2015).
Jereh Group, Jereh Fracturing Equipment. YouTube (Jun. 8, 2015), https://www.youtube.com/watch?v=m0vMiq84P4Q.
Transcript of Jereh Group, Jereh Fracturing Equipment, YouTube (Jun. 8, 2015), https://www.youtube.com/watch?v=m0vMiq84P4Q.
Ferdinand P. Beer et al., Mechanics of Materials (6th ed. 2012).
Weir Oil & Gas Introduces Industry's First Continuous Duty 5000-Horsepower Pump, Weir Group (Jul. 25, 2019), https://www.global.weir/newsroom/news-articles/weir-oil-and-gas-introduces-industrys-first-continuous-duty-5000-horsepower-pump/.

(56) References Cited

OTHER PUBLICATIONS

2012 High Horsepower Summit Agenda, Natural Gas for High Horsepower Applications (Sep. 5, 2012).
Review of HHP Summit 2012, Gladstein, Neandross & Associates https://www.gladstein.org/gna-conferences/high-horsepower-summit-2012/.
Green Field Energy Services Deploys Third New Hydraulic Fracturing System, Green Field Energy Services, Inc. (Jul. 11, 2012), https://www.prnewswire.com/news-releases/green-field-energy-services-deploys-third-new-hydraulic-fracturing-spread-162113425.
Karen Boman, Turbine Technology Powers Green Field Multi-Fuel Frack Pump, Rigzone (Mar. 7, 2015), as available on Mar. 14, 2015, https://web.archive.org/web/20150314203227/https://www.rigzone.co m/news/oil-gas/a/124883/Turbine_Technology_Powers_Green_Field_ MultiFuel_Frack_Pump.
"Turbine Frac Units," WMD Squared (2012), https://wmdsquared.com/ work/gfes-turbine-frac-units/.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
"Honghua developing new-generation shale-drilling rig, plans testing of frac pump"; Katherine Scott; Drilling Contractor; May 23, 2013; accessed at https://www.drillingcontractor.org/honghua-developing-new-generation-shale-drilling-rig-plans-testing-of-frac-pump-23278.
International Search Report and Written Opinion for PCT/US2022/030647, dated Oct. 7, 2022.
De Gevigney et al., "Analysis of no-load dependent power losses in a planetary gear train by using thermal network method", International Gear Conference 2014: Aug. 26-28, 2014, Lyon, pp. 615-624.
Special-Purpose Couplings for Petroleum, Chemical, and Gas Industry Services, API Standard 671 (4th Edition) (2010).
The Application of Flexible Couplings for Turbomachinery, Jon R. Mancuso et al., Proceedings of the EighteenthTurbomachinery Symposium (1989).
Pump Control With Variable Frequency Drives, Kevin Tory, Pumps & Systems: Advances in Motors and Drives, Reprint from Jun. 2008.
Fracture Design and Stimulation, Mike Eberhard, P.E., Wellconstruction & Operations Technical Workshop inSupport of the EPA Hydraulic Fracturing Study, Mar. 10-11, 2011.
General Purpose vs. Special Purpose Couplings, Jon Mancuso, Proceedings of the Twenty-Third TurbomachinerySymposium (1994).
Overview of Industry Guidance/Best Practices on Hydraulic Fracturing (HF), American Petroleum Institute, © 2012.
API Member Companies, American Petroleum Institute, WaybackMachine Capture, https://web.archive.org/web/20130424080625/http://api.org/globalitems/globalheaderpages/membership/api-member-companies, accessed Jan. 4, 2021.
API's Global Industry Services, American Petroleum Institute, © Aug. 2020.
About API, American Petroleum Institute, https://www.api.org /about, accessed Dec. 30, 2021.
About API, American Petroleum Institute, WaybackMachine Capture, https://web.archive.org/web/20110422104346 /http://api.org/aboutapi/, captured Apr. 22, 2011.
Publications, American Petroleum Institute, WaybackMachine Capture, https://web.archive.org/web/20110427043936 /http://www.api.org:80/Publications/, captured Apr. 27, 2011.
Procedures for Standards Development, American Petroleum Institute, Third Edition (2006).
WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.
2011 Publications and Services, American Petroleum Institute (2011).
Standards, American Petroleum Institute, WaybackMachine Capture, https://web.archive.org/web/20110207195046/http:/www.api.org/Standards/, captured Feb. 7, 2011; and https://web.archive.org/web/20110204112554/http://global.ihs.com/?RID=API1, captured Feb. 4, 2011.
IHS Markit Standards Store, https://global.ihs.com/doc_ detail.cfm?document_name=API%20STD%20674&item_s_key=00010672#doc-detail-history-anchor, accessed Dec. 30, 2021; and https://global.ihs.com/doc_detail.cfm?&input_doc _number=671&input_doc_title=&document_name=API%20STD%20671&item_s_key=00010669&item_key_date=890331&origin=DSSC, accessed Dec. 30, 2021.
Dziubak, Tadeusz, "Experimental Studies of Dust Suction Irregularity from Multi-Cyclone Dust Collector of Two-Stage Air Filter", Energies 2021, 14, 3577, 28 pages.
Final written decision of PGR2021-00102 dated Feb. 6, 2023.
Final written decision of PGR2021-00103 dated Feb. 6, 2023.

* cited by examiner

AUTOMATED DIAGNOSTICS OF ELECTRONIC INSTRUMENTATION IN A SYSTEM FOR FRACTURING A WELL AND ASSOCIATED METHODS

PRIORITY CLAIM

This is a continuation of U.S. Non-Provisional application Ser. No. 17/810,877, filed Jul. 6, 2022, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/551,359, filed Dec. 15, 2021, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/395,298, filed Aug. 5, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,255,174, issued Feb. 22, 2022, which is a continuation of U.S. Non-Provisional application Ser. No. 17/301,247, filed Mar. 30, 2021, titled "AUTOMATED DIAGNOSTICS OF ELECTRONIC INSTRUMENTATION IN A SYSTEM FOR FRACTURING A WELL AND ASSOCIATED METHODS," now U.S. Patent No. 11,220,895, issued January 11, 2022, which claims priority to and the benefit of, under 35 U.S.C. § 119(e), U.S. Provisional Application No. 62/705,375, filed Jun. 24, 2020, titled "AUTOMATED DIAGNOSTICS OF ELECTRONIC INSTRUMENTATION IN A SYSTEM FOR FRACTURING A WELL AND ASSOCIATED METHODS," the disclosures of which are incorporated herein by reference in their entireties.

TECHNOLOGICAL FIELD

This disclosure relates generally to fracturing operations for oil and gas wells, and in particular, to controls for and diagnostics of electronic instrumentation in a system for fracturing a well and associated methods.

BACKGROUND

Fracturing is an oilfield operation that stimulates production of hydrocarbons, such that the hydrocarbons may more easily or readily flow from a subsurface formation to a well. For example, a fracturing system may be configured to fracture a formation by pumping a fracking fluid into a well at high pressure and high flow rates. Some fracking fluids may take the form of a slurry including water, proppants (e.g., sand), and/or other additives, such as thickening agents and/or gels. The slurry may be forced via one or more pumps into the formation at rates faster than can be accepted by the existing pores, fractures, faults, or other spaces within the formation. As a result, pressure builds rapidly to the point where the formation fails and begins to fracture.

By continuing to pump the fracking fluid into the formation, existing fractures in the formation are caused to expand and extend in directions farther away from a well bore, thereby creating flow paths to the well bore. The proppants may serve to prevent the expanded fractures from closing when pumping of the fracking fluid is ceased or may reduce the extent to which the expanded fractures contract when pumping of the fracking fluid is ceased. Once the formation is fractured, large quantities of the injected fracking fluid are allowed to flow out of the well, and the production stream of hydrocarbons may be obtained from the formation.

Hydraulic fracturing units are often equipped with analog sensors reading voltage or current values and converting them into an accurate variable measurement. The raw values are used through system logic to perform pumping operations, alert of faulty equipment and detect harmful conditions. The sensors are therefore stringently monitored for accuracy to ensure all related controls are being carried out to the operator's intent. In some cases, electric instruments such as discharge pressure transducers are equipped with a calibration function that can be performed by the operator to ensure than the accuracy of the transducer is the same. This cannot be done while operating the equipment as this would disrupt the use of the transducer.

BRIEF SUMMARY

Example implementations of the present disclosure provide a supervisory control unit and associated method for performing automated diagnostics of physical components and/or electronic instrumentation, such as one or more of transducers onboard one or more hydraulic fracturing units or otherwise distributed throughout a system for fracturing a well. The diagnostics may facilitate equipment maintenance, maintenance schedules and troubleshooting, and may ensure operational accuracy of the electronic instrumentation. The present disclosure includes, without limitation, the following example implementations.

In some embodiments, a supervisory control unit may receive measurements of conditions of hydraulic drive equipment onboard one or more hydraulic fracturing units. Each hydraulic fracturing unit may also include a reciprocating plunger pump configured to pump a fracturing fluid, a powertrain configured to power the reciprocating plunger pump, and auxiliary equipment driven by the hydraulic drive equipment to support operation of the hydraulic fracturing unit including the reciprocating plunger pump and the powertrain. The supervisory control unit may determine health of the hydraulic drive equipment from the measurements, and control the auxiliary equipment to start when the health of the hydraulic drive equipment is sufficient to drive the auxiliary equipment.

The health of the hydraulic drive equipment may refer to a status of the hydraulic drive equipment based on various conditions of the equipment. The health or status of the hydraulic drive equipment may be based on detrimental conditions endured by the hydraulic drive equipment, the severity of the detrimental conditions, and if the hydraulic drive equipment has been placed on a reduced power output due to the detrimental conditions. One detrimental condition may include high vibration on a fracturing pump during a fracturing stage. For example, the supervisory controller and/or local controller for the fracturing pump may include a vibration threshold. If the threshold is exceeded during a fracturing stage, the supervisory controller may determine that a detrimental condition has occurred and that the health of the fracturing pump is poor or some other various state, as will be understood by those skilled in the art. Other detrimental conditions may be considered for all the equipment at the wellsite, as will be understood by those skilled in the art.

In additional embodiments, the supervisory control unit may receive measurements of conditions of lubrication and cooling equipment onboard one or more hydraulic fracturing units. In these examples, the auxiliary equipment of each hydraulic fracturing unit may also include the lubrication and cooling equipment. The supervisory control unit may monitor temperature of process fluid in the lubrication and cooling equipment from the measurements. In some further examples, the supervisory control unit may receive at least some of the measurements from inlet and outlet ports of a radiator of a heat exchanger assembly for the reciprocating plunger pump, the engine, the powertrain or the auxiliary equipment. In some of these further examples, the supervisory control unit may monitor an extent to which the process fluid is cooled by the radiator.

In further embodiments, the supervisory control unit may receive measurements of pressure from a wellhead pressure transducer configured to measure pressure of fracturing fluid at a wellhead, or pump output pressure transducers configured to measure pressure of fracturing fluid discharged by reciprocating plunger pumps of hydraulic fracturing units. In some of these examples, the supervisory control unit may compare the measurements to an average of the measurements, and determine if a measurement of pressure at the wellhead or any of the reciprocating plunger pumps is outside an allowable calibration range. The supervisory control unit may flag the measurement when the measurement of pressure is outside the allowable calibration range.

In some embodiments, a diagnostic control assembly to identify a status associated with components of a plurality of hydraulic fracturing units including a prime mover positioned to drive a hydraulic fracturing pump to pump fracturing fluid into a wellhead via a manifold, may include a plurality of sensors positioned to generate sensor signals indicative of operating parameters associated with one or more of at least one of the plurality of hydraulic fracturing units or the manifold, and a supervisory control unit. The supervisory control unit may be configured to receive the plurality of sensor signals and determine whether one or more of the plurality of sensors is generating signals outside a calibration range, and when one or more of the plurality of sensors is generating signals outside the calibration range, generate a calibration signal indicative of the one or more of the plurality of sensors generating signals outside the calibration range. The supervisory control unit may also, or alternatively, be configured to receive the plurality of sensor signals and determine whether a fluid parameter associated with an auxiliary system of one or more of the plurality of hydraulic fracturing units is indicative of a fluid-related problem, and when the fluid parameter is indicative of a fluid-related problem, generate a fluid signal indicative of the fluid-related problem. The supervisory control unit may also, or alternatively, be configured to receive the plurality of sensor signals and determine whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generate a lubrication temperature signal indicative of the lubrication fluid temperature greater than the maximum lubrication temperature. The supervisory control unit may also, or alternatively, be configured to receive the plurality of sensor signals and determine an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generate a cooling signal indicative of the heat exchanger assembly operating with a low effectiveness.

In some embodiments, a supervisory control unit to monitor a status associated with components of a plurality of hydraulic fracturing units including a prime mover positioned to drive a hydraulic fracturing pump to pump fracturing fluid into a wellhead via a manifold may include a memory having computer-readable instructions stored therein, and a processor configured to access the memory, and execute the computer-readable instructions. The computer-readable instructions may cause the supervisory control unit to receive a plurality of sensor signals and determine whether one or more of the plurality of sensor signals is indicative of a sensor generating sensor signals outside a calibration range, and when a sensor is generating signals outside the calibration range, generate a calibration signal indicative of the sensor generating signals outside the calibration range. The computer-readable instructions may also, or alternatively, cause the supervisory control unit to receive a plurality of sensor signals and determine whether a fluid parameter associated with an auxiliary system of one or more of the plurality of hydraulic fracturing units is indicative of a fluid-related problem, and when the fluid parameter is indicative of a fluid-related problem, generate a fluid signal indicative of the fluid-related problem. The computer-readable instructions may also, or alternatively, cause the supervisory control unit to receive a plurality of sensor signals and determine whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generate a lubrication temperature signal indicative of the lubrication fluid temperature greater than the maximum lubrication temperature. The computer-readable instructions may also, or alternatively, cause the supervisory control unit to receive a plurality of sensor signals and determine an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generate a cooling signal indicative of the heat exchanger assembly operating with a low effectiveness.

In some embodiments, a method to identify a status associated with components of a plurality of hydraulic fracturing units including a prime mover positioned to drive a hydraulic fracturing pump to pump fracturing fluid into a wellhead via a manifold, may include receiving a plurality of sensor signals, the plurality of sensor signals being indicative of operating parameters associated with one or more of at least one of the plurality of hydraulic fracturing units or the manifold. The method also may include determining whether one or more of the plurality of sensors is generating signals outside a calibration range, and when one or more of the plurality of sensors is generating signals outside the calibration range, generating a calibration signal indicative of the one or more of the plurality of sensors generating signals outside the calibration range. The method also, or alternatively, may include determining whether a fluid parameter associated with an auxiliary system of one or more of the plurality of hydraulic fracturing units is indicative of a fluid-related problem, and when the fluid parameter is indicative of a fluid-related problem, generating a fluid signal indicative of the fluid-related problem. The method further, or alternatively, may include determining whether lubrication associated with one or more of the prime mover, the hydraulic fracturing pump, or a transmission associated with one or more of the plurality of hydraulic fracturing units has a lubrication fluid temperature greater than a maximum lubrication temperature, and when one or more of the plurality of hydraulic fracturing units has a lubrication fluid temperature greater than the maximum lubrication temperature, generating a lubrication temperature signal indicative of the lubrication fluid temperature greater than the maximum lubrication temperature. The method also, or alternatively, may include determining an extent to which a heat exchanger assembly associated with one or more of the plurality of hydraulic fracturing units is cooling fluid passing through the heat exchanger assembly, and when the extent to which the heat exchanger assembly is cooling fluid is below a minimum cooling effectiveness, generating a cooling signal indicative of the heat exchanger assembly operating with a low effectiveness.

In some embodiments, a method to identify inaccuracies of a plurality of pressure sensors configured to generate signals indicative of fluid pressure associated with operation of components of a plurality of hydraulic fracturing units including a prime mover positioned to drive a hydraulic fracturing pump to pump fracturing fluid into a wellhead via a manifold, may include receiving a plurality of unit pressure signals generated by a plurality of respective unit pressure sensors, the plurality of unit pressure signals being indicative of respective output pressures of the plurality of hydraulic fracturing units. The method also may include receiving a manifold pressure signal generated by a manifold pressure sensor, the manifold pressure signals being indicative of pressure associated with fluid flowing in the manifold. The method further may include, based at least in part on the plurality of unit pressure signals and the manifold pressure signal, determining whether one or more of the manifold pressure sensor or one or more of the plurality of unit pressure sensors is generating signals outside a calibration range.

In some embodiments, a method to determine a status of an auxiliary system associated with a hydraulic fracturing unit including a prime mover positioned to drive a hydraulic fracturing pump to pump fracturing fluid into a wellhead via a manifold, may include receiving a fluid level signal indicative of a level of fluid in a fluid reservoir. The method also may include, when the fluid level signal is indicative of a fluid level below a minimum fluid level, generating a low level signal indicative of the fluid level being below the minimum fluid level. The method further may include, based at least in part on the low level signal, preventing the hydraulic fracturing unit from commencing a hydraulic fracturing operation, and/or causing generation of a maintenance signal indicative of initiating maintenance associated with the fluid.

In some embodiments, a method to determine a cooling effectiveness of a heat exchanger assembly associated with a hydraulic fracturing unit including a prime mover positioned to drive a hydraulic fracturing pump to pump fracturing fluid into a wellhead via a manifold, may include receiving an inlet temperature signal indicative of an inlet temperature of fluid flowing through an inlet of the heat exchanger assembly, and receiving an outlet temperature signal indicative of an outlet temperature of fluid flowing through an outlet of the heat exchanger assembly. The method also may include determining the inlet temperature associated with fluid flowing through the inlet of the heat exchanger assembly, and determining the outlet temperature associated with the fluid flowing out of an outlet of the heat exchanger assembly. The method further may include determining a temperature difference between the inlet temperature and the outlet temperature, and comparing the temperature difference to historical data associated with operation of the heat exchanger assembly during prior operation. The method still further may include, based at least in part on the comparing, determining the cooling effectiveness of the heat exchanger assembly.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1:
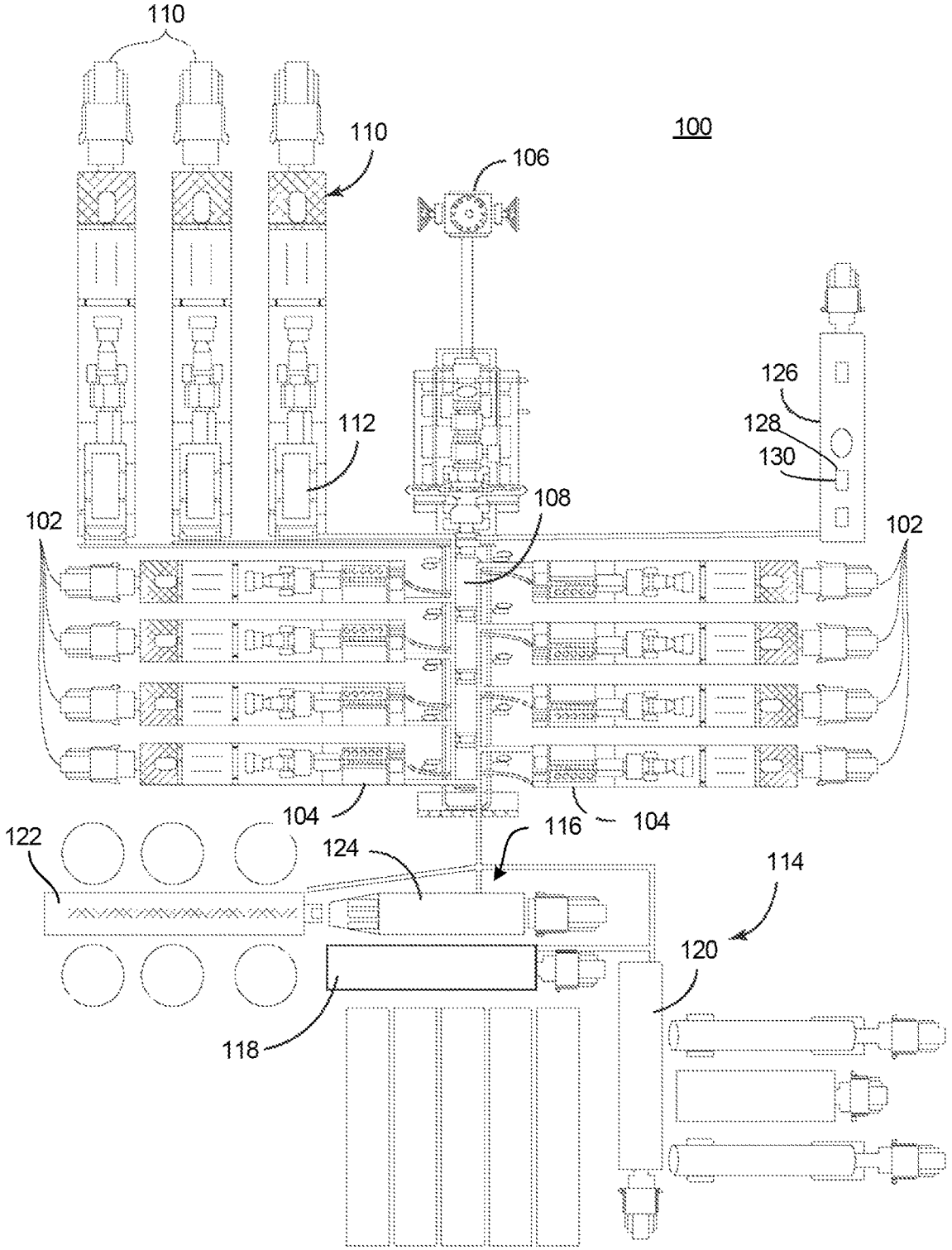
Figure 2:
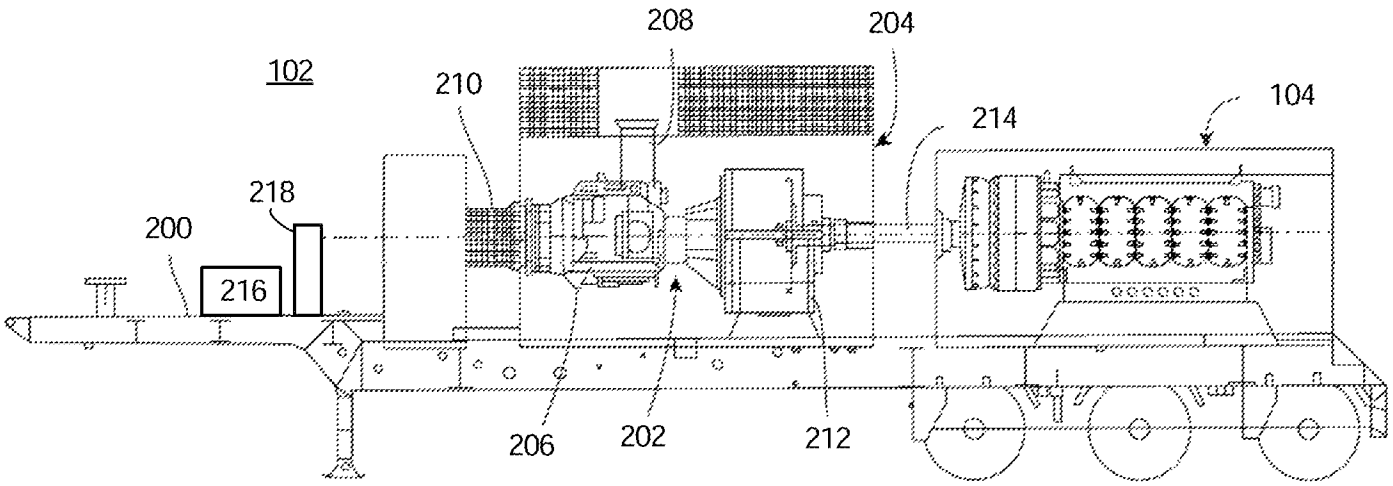
Figure 3:
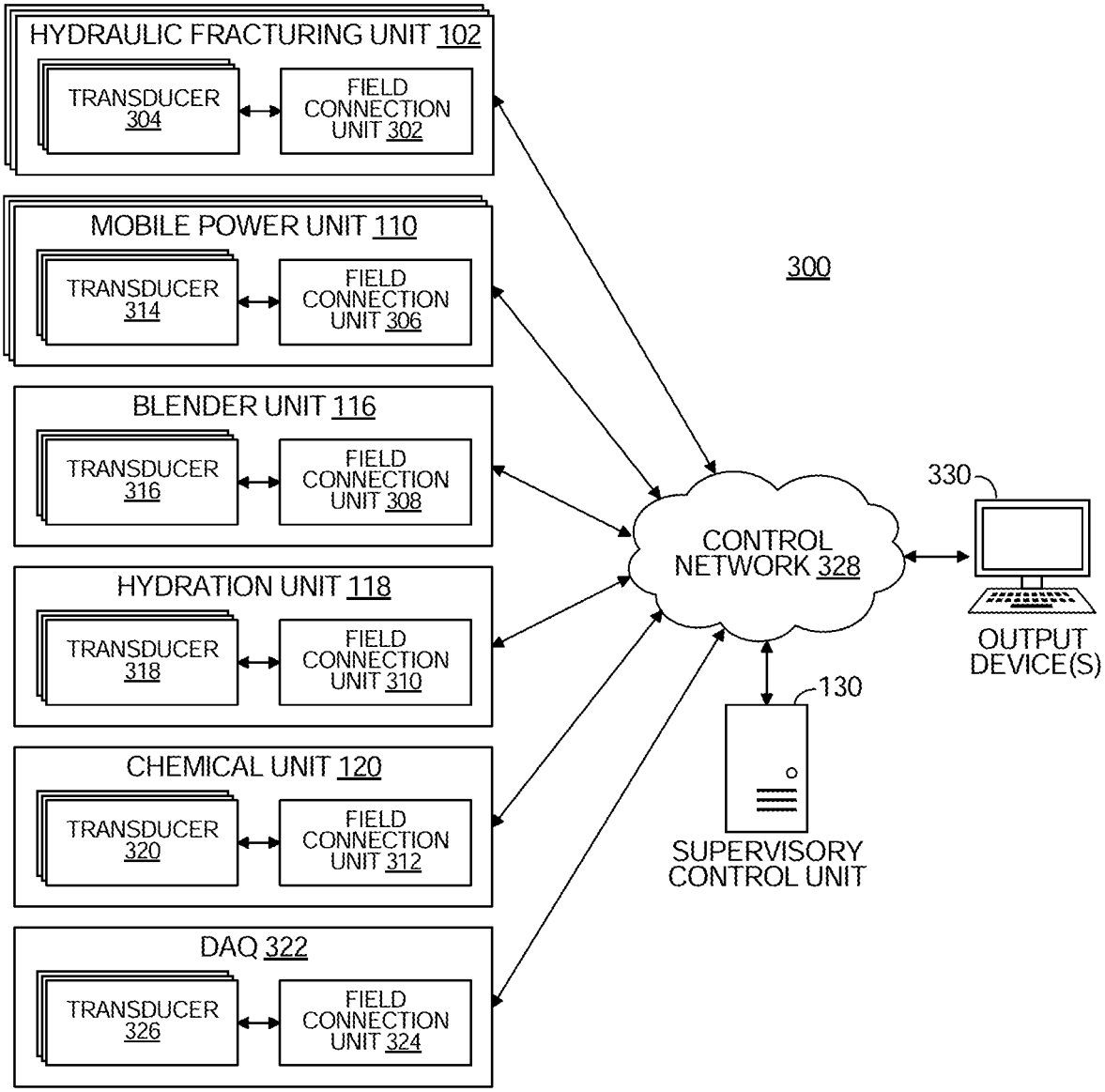

Having thus described aspects of the disclosure in the foregoing general terms, reference will now be made to the accompanying figures, which are not necessarily drawn to scale, and wherein:

FIG. 1 illustrates a system for fracturing a well according to some embodiments of the disclosure;

FIG. 2 illustrates a hydraulic fracturing unit of the system, according to some embodiments of the disclosure; and FIG. 3 illustrates a network architecture for the system according to some embodiments of the disclosure.

Figure 4:
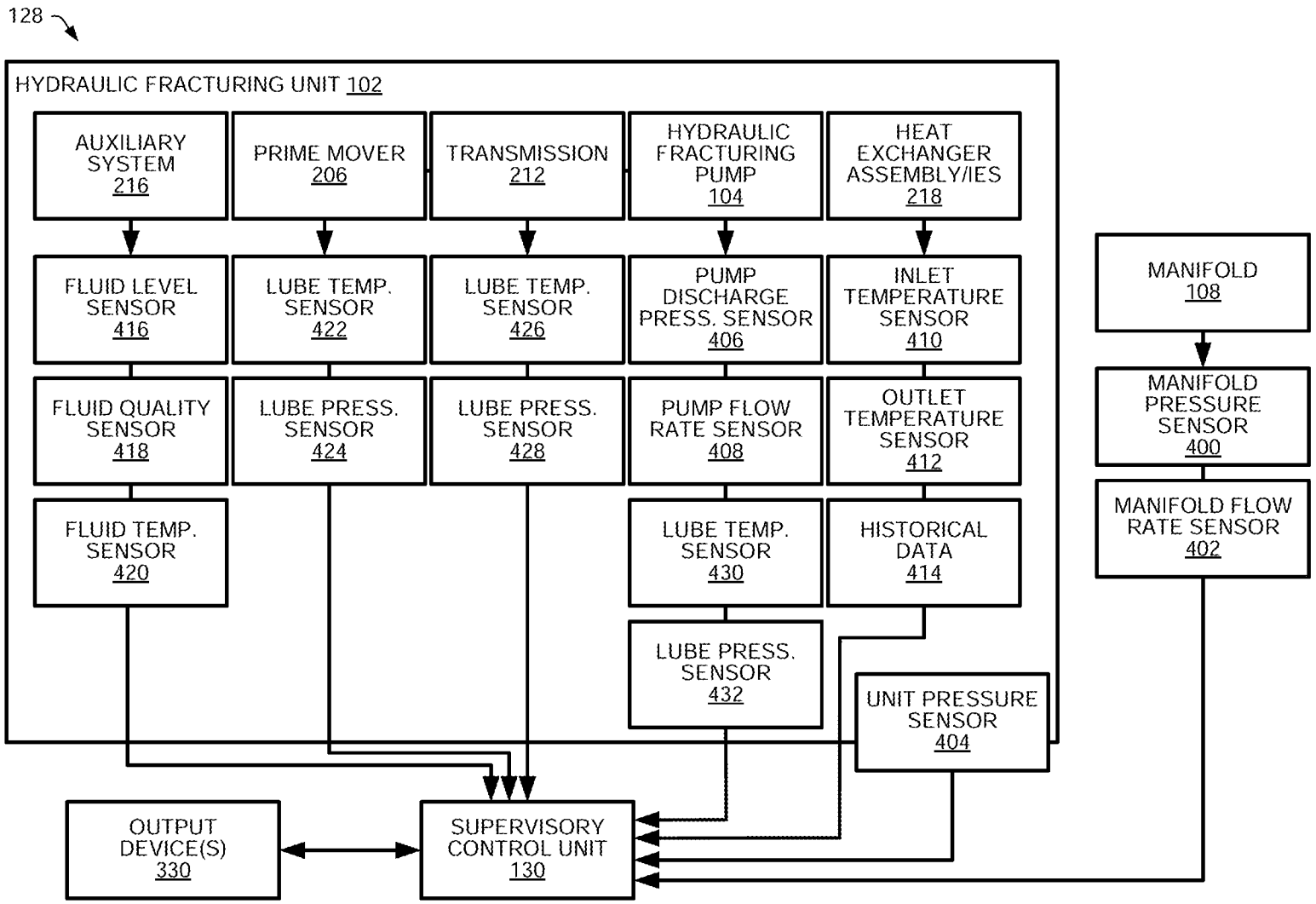

FIG. 4 schematically illustrates an example diagnostic control assembly including a supervisory control unit associated with an example hydraulic fracturing unit including example sensors, according to some embodiments of the disclosure.

Figure 5:
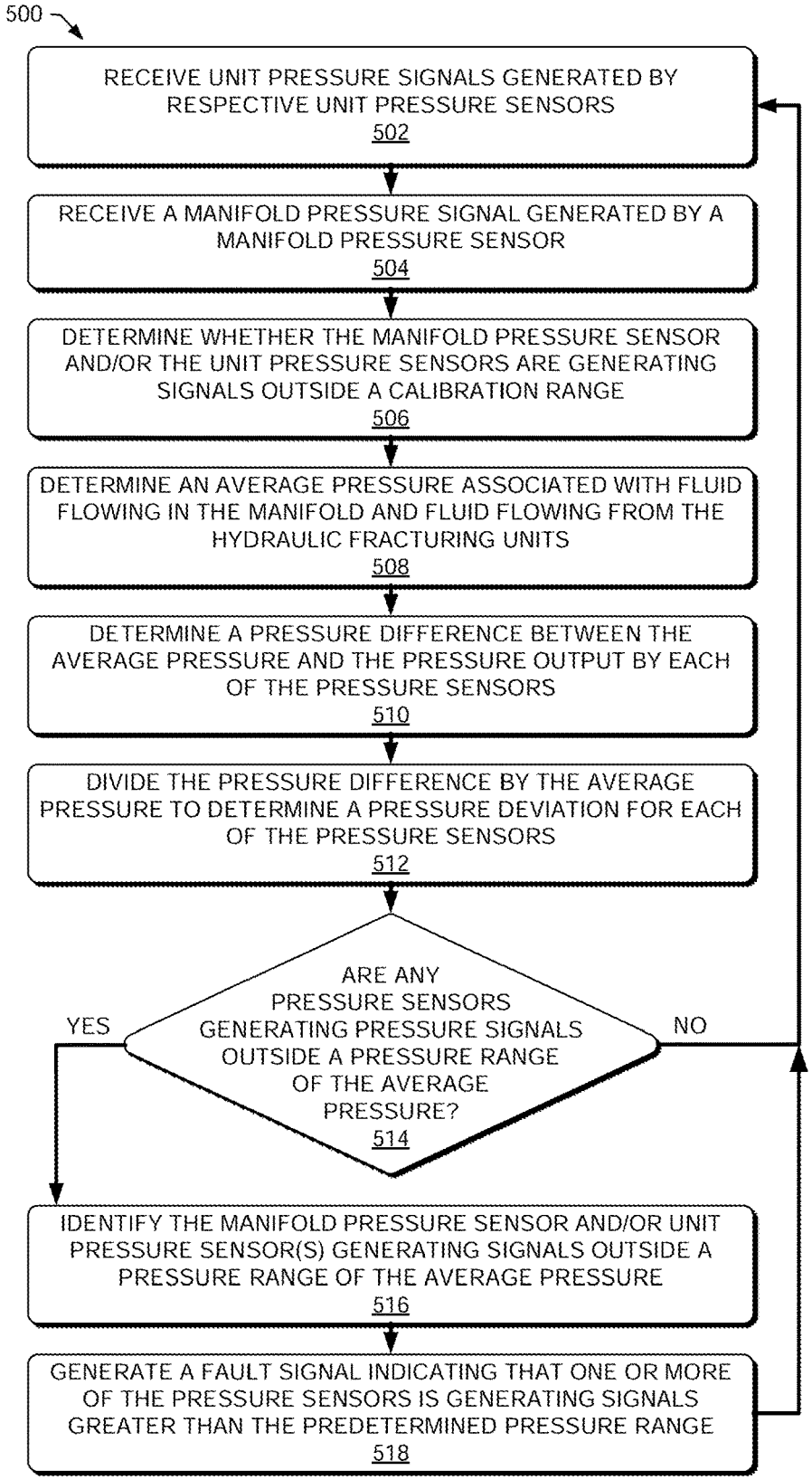

FIG. 5 is a block diagram of an example method to identify inaccuracies of a plurality of pressure sensors configured to generate signals indicative of fluid pressure associated with operation of components of a plurality of hydraulic fracturing units, according to embodiments of the disclosure.

Figure 6A:
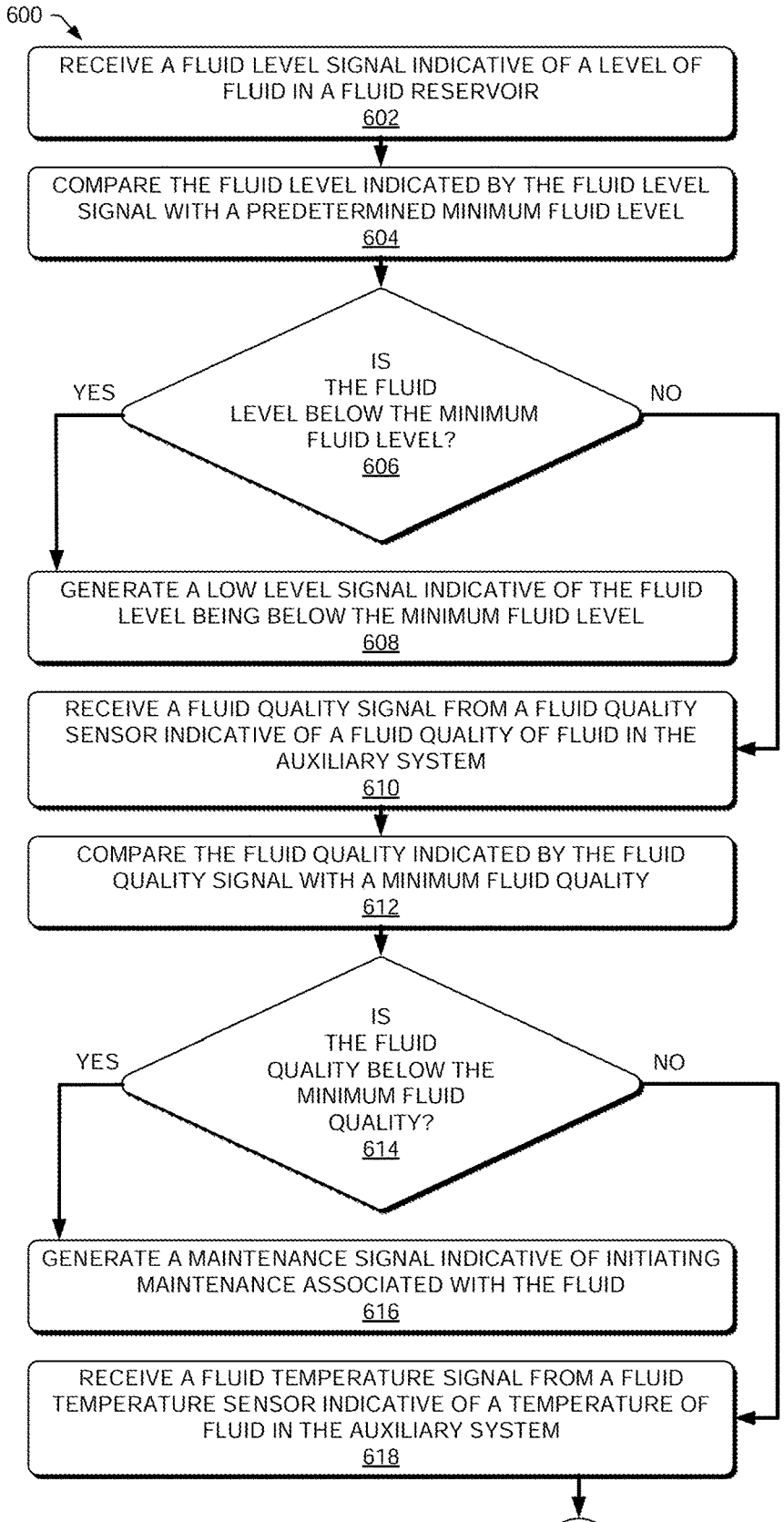

FIG. 6A is a block diagram of an example method to determine a status of an auxiliary system associated with a hydraulic fracturing unit, according to embodiments of the disclosure.

Figure 6B:
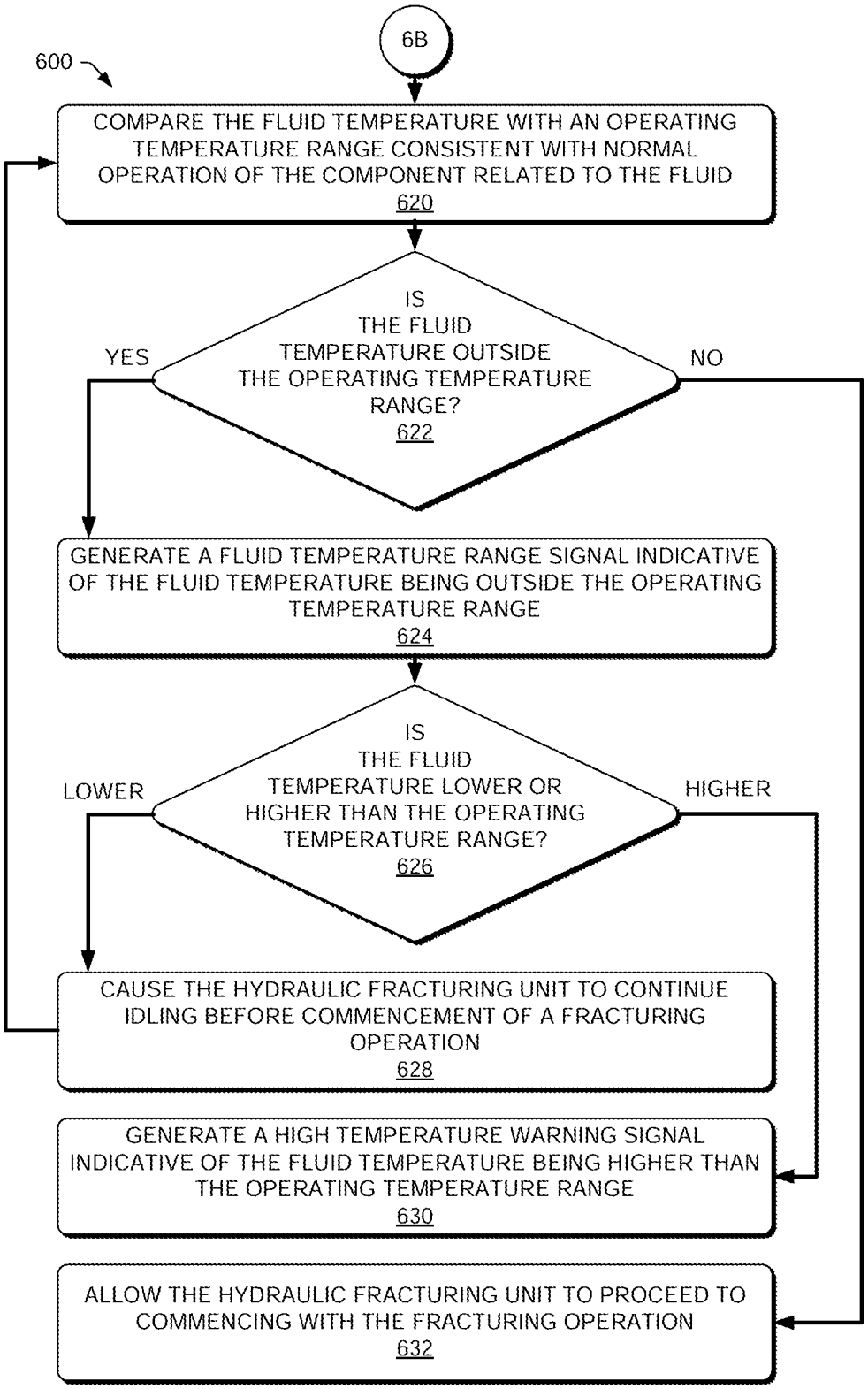

FIG. 6B is a continuation of the block diagram of the example method to determine a status of an auxiliary system shown in FIG. 6A, according to embodiments of the disclosure.

Figure 7A:
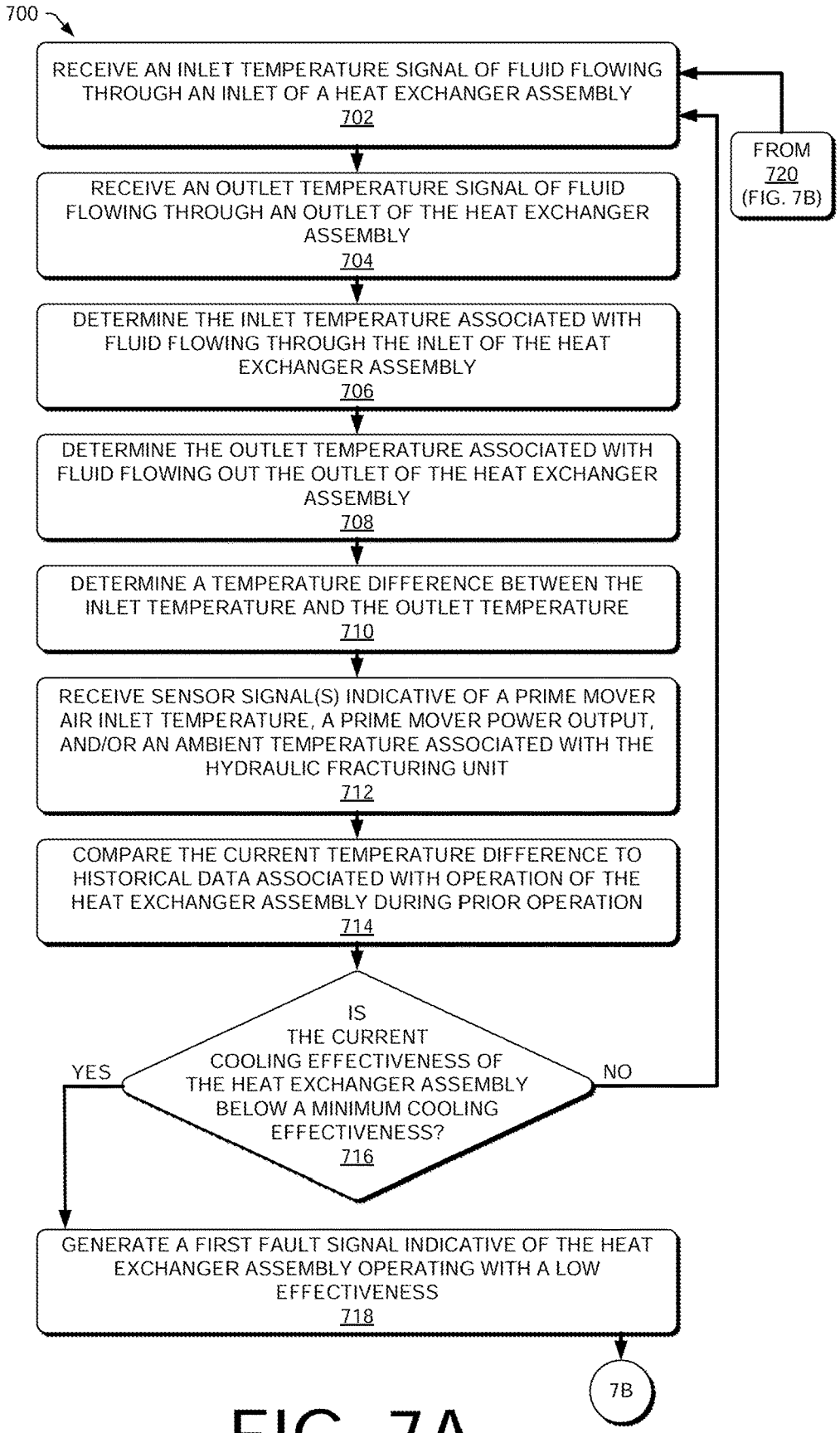

FIG. 7A is a block diagram of an example method to determine a cooling effectiveness of a heat exchanger assembly associated with a hydraulic fracturing unit, according to embodiments of the disclosure.

Figure 7B:
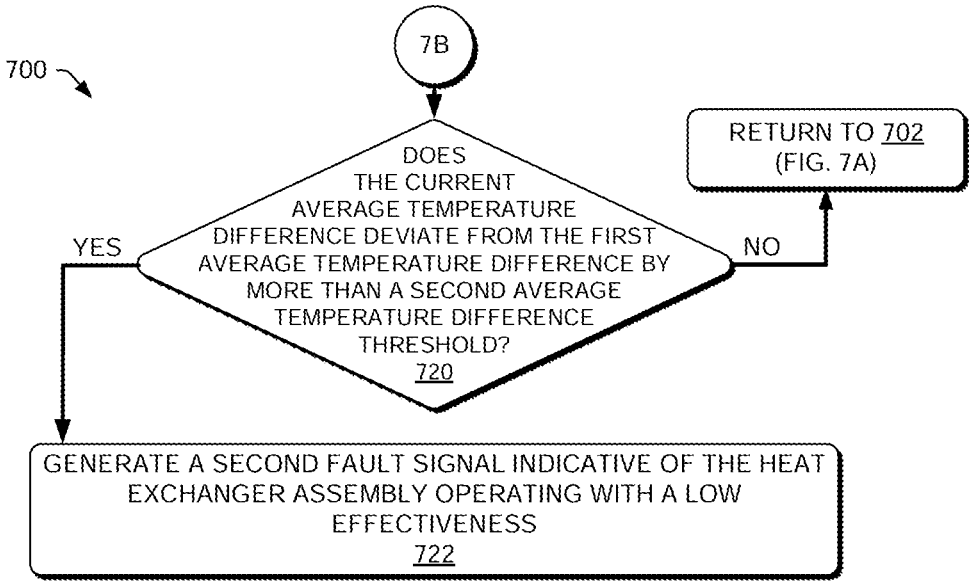

FIG. 7B is a continuation of the block diagram of the example method to determine a cooling effectiveness shown in FIG. 7A, according to embodiments of the disclosure.

Figure 8:
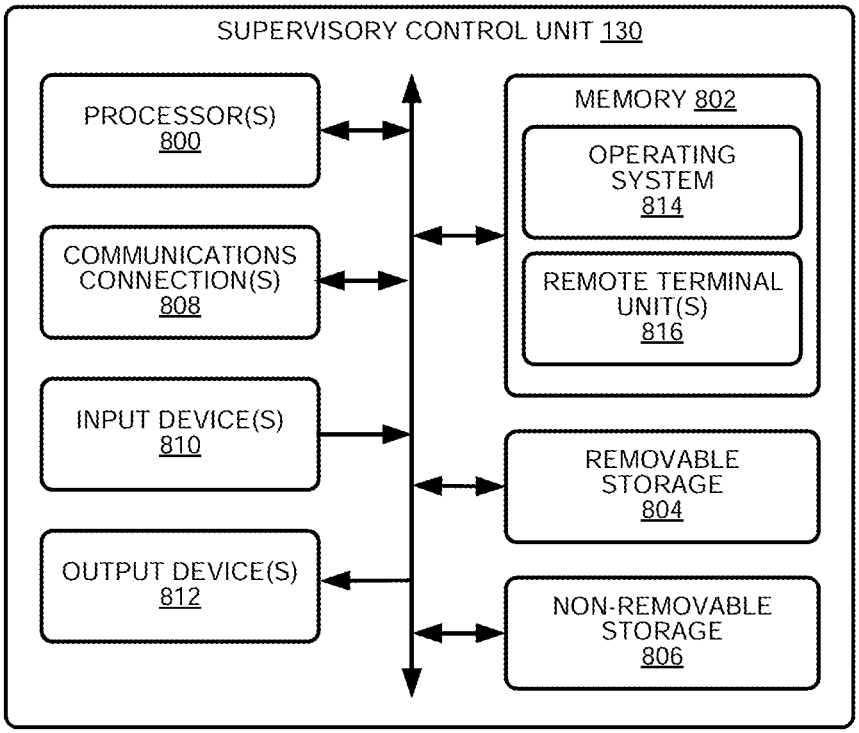

FIG. 8 is a schematic diagram of an example supervisory control unit configured to semi- or fully-autonomously perform diagnostics of components and/or electronic instrumentation onboard hydraulic fracturing units or otherwise distributed throughout a hydraulic fracturing system, according to embodiments of the disclosure.

DETAILED DESCRIPTION

Some implementations of the present disclosure will now be described more fully hereinafter with reference to the accompanying figures, in which some, but not all, implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second, or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships, or the like, unless otherwise stated, any one or more, if not all, of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form.

FIG. 1 illustrates a system 100 for fracturing a well according to some example implementations of the present disclosure. As shown, the system 100 generally includes a plurality of hydraulic fracturing units 102 and respective hydraulic fracturing pumps 104. The hydraulic fracturing units 102 may be arranged around a wellhead 106 to supply the wellhead 106 with high-pressure fracturing fluids and recover oil and/or gas from the wellhead 106 as will be understood by those skilled in the art. As shown, the hydraulic fracturing units 102 may be positioned and configured to discharge high-pressure fluid to a manifold 108, such that the high-pressure fluid is provided to the wellhead 106. In some examples, the system 100 also includes one or more mobile power units 110 with respective electrical generators 112 configured to provide electrical power to the system 100.

As also shown, the system 100 may include backside equipment 114, such as a blender unit 116, a hydration unit 118, and/or a chemical unit 120. The blender unit 116 may be positioned and configured to provide a flow of fluid to the fracturing pumps 104, which is pressurized by and discharged from the fracturing pumps 104 into the manifold 108. The blender unit 116 may include one or more screw conveyors 122 positioned and configured to provide proppant to a mixer 124 of the blender unit 116. The blender unit 116 may also include a discharge pump configured to draw fluid from the mixer 124, such that a flow of fluid is provided from the blender unit 116 to the fracturing pumps 104. The fluid from the mixer 124 may include proppant provided by the screw conveyors and/or chemicals for the fluid of the fracturing pumps 116. When blender unit 116 provides proppant to the fracturing pumps 104, the proppant is in a slurry, which may be considered a fluid, as will be understood by those skilled in the art.

The system 100 may include a data center 126, including a diagnostic control assembly 128, which may include (or be a component of) a supervisory control unit 130 that provides facilities for communication with and/or control of the hydraulic fracturing units 102, the mobile power units 110, and the backside equipment 114, such as by wired or wireless data links directly or across one or more networks. The data center may be a mobile control unit in the form of a trailer or a van, as will be understood by those skilled in the art. As used herein, the term "fracturing pump" may be used to refer to one or more of the hydraulic fracturing pumps 104 of the system 100. In some embodiments, all of the hydraulic fracturing pumps 104 may be controlled by the supervisory control unit 130, such that to an operator or user of the supervisory control unit 130, the hydraulic fracturing pumps 104 may be controlled as a single pump or pumping system.

FIG. 2 illustrates a hydraulic fracturing unit 102, according to some embodiments of the present disclosure. The hydraulic fracturing unit 102 may include a fracturing pump 104, such as a reciprocating pump, connected to a chassis 200 and positioned and configured to pump a fracturing fluid into the wellhead 106 via the manifold 108. In some embodiments, the chassis 200 may include a trailer (e.g., a flat-bed trailer) and/or a truck body, to which one or more of the components of the hydraulic fracturing unit 102 may be connected. For example, the components may be carried by trailers and/or incorporated into trucks, so that they may be easily transported between well sites, assembled, used during a fracturing operation, as least partially disassembled, and transported to another wellsite.

In some embodiments, the fracturing pump 104 may be reciprocating plunger pump, including a power end and a fluid end. The power end may be configured to transform rotational motion and energy from a powertrain 202 into the reciprocating motion that drives plungers in the fluid end. In the fluid end, the plungers force fluid into a pressure chamber that is used to create high pressure for well servicing. The fluid end may also include a discharge valve assembly and a suction valve assembly.

The hydraulic fracturing unit 102 may include an enclosure assembly 204 onboard the chassis 200, and housing the powertrain 202 configured to power the fracturing pump 104. For example, the powertrain 202 may include a prime mover 206 and a drivetrain. In some embodiments, the hydraulic fracturing unit 102 may be a direct drive turbine (DDT) unit in which the prime mover 206 is, or includes, a gas turbine engine (GTE), which may be operatively connected to an air intake duct 208 and an exhaust duct 210. As also shown, the drivetrain may include a reduction transmission 212 (e.g., gearbox) connected to a drive shaft 214, which, in turn, is connected to the fracturing pump 104, such as via an input shaft or input flange of the fracturing pump 104. Other types of GTE-to-pump arrangements are contemplated.

In some examples, the prime mover 206 may be a direct drive GTE. The GTE may be a dual-fuel or bi-fuel GTE, for example, operable using of two or more different types of fuel, such as natural gas and diesel fuel, although other types of fuel are contemplated. For example, a dual-fuel or bi-fuel GTE may be capable of being operated using a first type of fuel, a second type of fuel, and/or a combination of the first type of fuel and the second type of fuel. For example, the fuel may include compressed natural gas (CNG), natural gas, field gas, pipeline gas, methane, propane, butane, and/or liquid fuels, such as, for example, diesel fuel (e.g., #2 Diesel), bio-diesel fuel, bio-fuel, alcohol, gasoline, gasohol, aviation fuel, etc. Gaseous fuels may be supplied by CNG bulk vessels, a gas compressor, a liquid natural gas vaporizer, line gas, and/or well-gas produced natural gas. Other types and sources of fuel are contemplated. The prime mover 206 may be operated to provide horsepower to drive the fracturing pump 104 via the reduction transmission 212 to safely and successfully fracture a formation during a fracturing operation, such as a well stimulation project.

As schematically shown in FIG. 2, the hydraulic fracturing unit 102 also may include an auxiliary system 216 including auxiliary equipment located onboard the chassis 200, and configured to support operation of the hydraulic fracturing unit 102, including the fracturing pump 104 and the powertrain 202, as will be understood by those skilled in the art. The auxiliary equipment onboard the hydraulic fracturing unit 102 may include lubrication and cooling equipment, and at least some of the auxiliary equipment may be hydraulically driven by hydraulic drive equipment. The hydraulic drive equipment may include hydraulic pumps configured to pump hydraulic or other working fluid from one or more reservoirs through hydraulic lines to hydraulic motors. The hydraulic motors may be configured and positioned to receive the fluid as hydraulic power, which the hydraulic motors may use to drive various components of the auxiliary system 216. In some embodiments, the auxiliary system 216 may include electrically-powered components. Additionally, the hydraulic fracturing unit 104 may include an auxiliary fracturing pump.

During various operations, the hydraulic fracturing unit 102 may generate heat, for example, resulting from frictional engagement of pistons, bores or other components of the hydraulic fracturing unit 102. The lubrication and cooling equipment onboard the hydraulic fracturing unit 102 may therefore employ a fluid heat transfer medium, such as a natural or synthetic lubrication oil to reduce friction and/or absorb heat generated by the hydraulic fracturing unit 102. For example, the lubrication and/or cooling equipment may employ a fluid heat transfer medium to absorb heat from the fracturing pump 104, the prime mover 206, and/or the transmission 212, which may reduce heat associated with operation of the hydraulic fracturing unit 102. Even further, the hydraulically-driven auxiliary equipment may generate heat that may be absorbed by the hydraulic or other working fluid that provides and/or distributes hydraulic power. As described herein, this fluid heat transfer media, hydraulic fluid, working fluid, or other thermally-conductive fluid may be more generally referred to as process fluid.

The lubrication and cooling equipment onboard the hydraulic fracturing unit 102 may further include one or more heat exchanger assemblies 218 for cooling or transferring heat from in the aforementioned process fluids. In some embodiments, these heat exchanger assemblies 218 may include heat exchanger assemblies 218 for cooling process fluid from one or more of the fracturing pump 104, the prime mover 206, the transmission 212, and/or the auxiliary system 216. Even further, in some embodiments, the heat exchanger assemblies 218 may include separate heat exchanger assemblies for cooling process fluid from respective low-pressure and high-pressure portions of the power end of the fracturing pump 104.

The heat exchanger assemblies 218 may include fan-driven heat exchangers, tube and shell heat exchangers, or other suitable heat exchangers. In some embodiments, a suitable heat exchanger assembly may include one or more of each of a number of components, such as an intake fan motor configured to rotate a fan to cool process fluid carried through a radiator. In some examples, the radiator may be configured as a tube-and-shell heat exchanger in which conduits between inlet and outlet ports route the process fluid over a sufficient surface area to cause cooling of the process fluid. The radiator may be positioned in an airflow path at least partially provided by the fan to remove heat from the process fluid running through the conduits.

As shown in FIG. 1, as explained above, in some embodiments, the system 100 may include the supervisory control unit 130 configured and positioned to communicate with and/or assist with control of one or more of the hydraulic fracturing units 102, the mobile power units 110, and the backside equipment 114 (e.g., blender unit 116, the hydration unit 118, and/or the chemical unit 120), such as by wired or wireless data links directly or across one or more networks. FIG. 3 illustrates an example network architecture 300 for the system 100 according to some example embodiments. In some embodiments, the network architecture 300 may be implemented as an industrial control system (ICS), such as a supervisory control and data acquisition (SCADA) system, a distributed control system (DCS), or the like.

As shown in FIG. 3, the hydraulic fracturing units 102 may include respective field connection units 302 configured to enable the supervisory control unit 130 to communicate with the hydraulic fracturing units 102, and in particular transducers 304, which may include sensors, controllers, and/or actuators onboard the hydraulic fracturing units 102. Similarly, one or more of the mobile power units 110, the blender unit 116, the hydration unit 118, or and the chemical unit 120 may include respective field connection units 306, 308, 310, 312, transducers such as sensors 314, 316, 318, 320, and/or controllers. Further, in some embodiments, the system 100 may include a data acquisition (DAQ) arrangement 322 with a field connection unit 324 and/or one or more transducers 326 configured to provide measurements or data with respect to the fracturing operation. In some embodiments, the field connection units 302, 306, 308, 310, 312, and/or 324 may be or include local controllers. The backside equipment 114 and/or the hydraulic fracturing units 102 may each include one or more field connection units (e.g., local controllers) for various components or related to the backside equipment 114 and/or the hydraulic fracturing units 102.

The supervisory control unit 130 and one or more of the respective field connection units 302, 306, 310, 314, 318, or 322 may be configured to communicate by wired or wireless data links directly or across one or more networks, such as a control network 328. In some embodiments, the supervisory control unit 130 may be implemented as a supervisory computer, and the respective field connection units may be implemented as remote terminal units (RTUs), programmable logic controllers (PLCs), or some combination of RTUs and PLCs. The supervisory control unit 130 may be configured to communicate with one or more output devices 330, such as a terminal configured to provide a human-to-machine interface (HMI) to the supervisory control unit 130. The supervisory control unit 130 may be integrated, co-located, or communicate by wired or wireless data links directly or across the control network 328.

In some embodiments, the supervisory control unit 130 may be configured to communicate with the transducers 304, 314, 316, 318, 320, and/or 326 for communication and/or control of the system 100, such as to enable the supervisory control unit 130 to control performance of pumping operations, provide alerts of faulty equipment, and/or detect harmful conditions. In some embodiments, the at least some of the transducers 304 onboard the hydraulic fracturing units 102 may include one or more transducers configured to generate signals indicative of conditions of the hydraulic drive equipment, which may be communicated to the supervisory control unit 130. These transducers 304 may include, for example, one or more pressure transducers or sensors, temperature transducers or sensors, flow meters, fluid condition meters, fluid level sensors, or the like.

In some embodiments, the transducers 304 onboard the hydraulic fracturing units 102 may include one or more transducers configured to generate signals indicative of conditions of the lubrication and/or cooling equipment for the fracturing pump 104, the prime mover 206, the transmission 212, and/or the auxiliary system 216. These transducers 304 may include, for example, temperature transducers and/or fluid quality sensors. For example, the temperature transducers may include temperature transducers at the inlet and outlet ports of a heat exchanger (e.g., a radiator) of one or more of the heat exchanger assemblies 218.

Other examples of suitable transducers include the one or more transducers 326 of the DAQ arrangement 322. For example, such transducers may include one or more pressure transducers, such as one or more wellhead pressure transducers, one or more pump output pressure transducers, and/or one or more flow rate transducers. The one or more wellhead pressure transducers may be disposed at the wellhead 106 to generate signals indicative of pressure of the fluid at the wellhead. The one or more pump output pressure transducers may be disposed adjacent an output of one of the fracturing pumps 104 that is in fluid communication with the manifold 108. The one or more flow rate transducers may be disposed anywhere in the system 100 through which the fracturing fluid flows, such as at the blender unit 116, the output of the fracturing pumps 104, the manifold 108, and/or the wellhead 106. The fluid pressure at the output of the fracturing pumps 104 may be substantially the same as the fluid pressure in the manifold 108 and/or the wellhead 106. One or more of the fracturing pumps 104 may include a pump output pressure transducer, and the supervisory control unit 130 may be configured to calculate the fluid pressure provided to the wellhead 106, for example, as an average of the fluid pressure measured by each of the pump output pressure transducers.

According to embodiments, the supervisory control unit 130 may be configured to perform automated diagnostics of electronic instrumentation, such as one or more of the transducers 304, 314, 316, 318, 320, or 326. The diagnostics may facilitate equipment maintenance, maintenance schedules and troubleshooting, and may improve the operational accuracy of the electronic instrumentation.

For example, the supervisory control unit 130 may be configured to receive signals from the transducers 304 onboard the hydraulic fracturing units 102 indicative of conditions of the hydraulic drive equipment, and determine the health of the hydraulic drive equipment prior to starting auxiliary equipment. The supervisory control unit 130 may thereby improve the likelihood that hydraulic pumps 104 of the hydraulic drive equipment are not operated with an insufficient amount of process fluid (e.g., in their reservoir(s)). The supervisory control unit 130 may be configured to determine whether the quality of the process fluid is acceptable and/or that its temperature is within an acceptable operating range.

In some embodiments, the supervisory control unit 130 may be configured to receive signals from the transducers 304 onboard the hydraulic fracturing units 102 indicative of conditions of the lubrication and cooling equipment, and monitor temperature of the process fluid to determine whether the temperature is within an acceptable operating range and/or monitor fluid levels to determine whether the fluid levels are not below a minimum level. For example, the efficiency or effectiveness of a heat exchanger assembly may become reduced with operation by dirt or debris, reducing the effectiveness of the heat exchange process for cooling the fluid (e.g., coolant). Temperature transducers may be positioned at the inlet port and outlet port of the heat exchanger and generate signals indicative of the temperature of the fluid at the inlet port and the outlet port, and the supervisory control unit may be configured to receive the signals and monitor determine the effectiveness of the heat exchange between the hot cooling fluid and heat exchanger. In some embodiments, the supervisory control unit 130 may be configured to compare the effectiveness and/or thermal efficiency of the heat exchanger to the effectiveness and/or thermal efficiency of the heat exchanger during a prior operation, to determine whether the heat exchanger should be serviced prior to beginning a fracturing operation, for example, by removing dirt and debris from the heat exchanger. The supervisory control unit 130 may be configured to utilize an analog input into the supervisory control unit 130. For example, the analog input may be configured to communicate an electrical current based on the fluid level (for example, a 4 milliamp (mA) current for 0% full and 20 mA for 100% full). In such embodiments, the supervisory control unit 130 may be configured to calibrate the electrical current to a fluid level relationship. In some embodiments, the supervisory control unit 130 may be configured to activate interlocks, for example, to prevent one or more of the hydraulic fracturing units 102 from operating at a fluid level below a minimum fluid level and to generate a notification or prompt to an operator or user of the system 100, notifying the operator or user of the low fluid level. The supervisory control unit 130 may be configured to prevent start-up of an engine (a GTE, an auxiliary engine, etc.) based on fluid level determination, for example, when fluid levels are below the minimum fluid level.

In some embodiments, the supervisory control unit 130 may be configured to receive diagnostic signals related to the system 100. For example, the supervisory control unit 130 may be configured to monitor sensor signal strength and/or connection for backside equipment 114 and/or the hydraulic fracturing units 102. For example, if a sensor fails to send an update, if a sensor sends an update at a longer than expected time, if the supervisory control unit 130 fails to obtain an update from the sensor, and/or if the supervisory control unit 130 does not obtain an update from the sensor at a longer than an expected time, the supervisory control unit 130 may be configured to communicate one or more signals indicative of the sensor issue. The signal(s) may include a prompt that may include information related to the status of the sensor and/or a corresponding error message (for example, "sensor data not received"). In some embodiments, the supervisory control unit 130 may be configured to calibrate or recalibrate one or more of the sensors. For example, the supervisory control unit 130 may define a sensor output based at least in part on signals generated by the sensors and communicated to the supervisory control unit 130 and/or to the location of the sensor (e.g., to the component of the hydraulic fracturing unit 102 one which the sensor).

In some embodiments, the supervisory control unit 130 may be configured to receive signals from transducers 326 of the DAQ arrangement 322 that generate signals indicative of pressure, such as, the wellhead pressure transducer and/or the pump output pressure transducer and based at least in part on the signals, determine the pressure associated with the fluid at the DAQ arrangement 322. In some embodiments, the supervisory control unit 130 may be configured to compare the determined pressure to an average of the pressures determined based on other transducers of the system 100. From this comparison, the supervisory control unit 130 may be configured to determine whether the measurement of pressure at the wellhead 106 and/or at any of the fracturing pumps 104 is outside an allowable calibration range (e.g., from about 1% to about 8%, for example, from about 2% to about 4%); and if so, generate a signal indicative of the sensor generating signals outside of an acceptable range, which may be communicated to an operator or user, so that the operator or user may investigate the condition of the sensor. For example, the pressure level outside the calibration range may be indicative of a closed valve in a discharge line and/or suction line. During pumping, a closed suction valve may result in failure and possible removal of a hydraulic fracturing unit 102 from the system 100 before or during a fracturing operation. In some embodiments, pressure measurements may be utilized on a line providing fluid flow from the blender unit 116 to the hydraulic fracturing pump 104. Tolerances may be allowed for the pressure differential in the line. A threshold may be set at 20%. Such a threshold may indicate a collapsed hose or line. A pressure differential of 100% may indicate that a suction valve is closed.

In another example, the supervisory control unit 130 may be configured to collect and/or store the health data for one, some, or all of the components associated with the system 100. For example, the supervisory control unit 130 may be configured to generate and/or communicate the health data to the output device(s) 330. In some embodiments, the health data may be presented as a dashboard. For example, the health data may be shown as a color-coded status (for example, red for poor health and/or green for good health). The supervisory control unit 130 may be configured to present the health data as a dashboard on the output device(s) 330. Such a dashboard may be presented as a series of tabs, for example, per each of the components of the system 100. Each tab may include various data points, as well as the health data or health status for the component(s) that correspond to the tab. The supervisory control unit 130 may be configured to generate and/or communicate signals indicative of prompts or notifications to the output device(s) 330, such as critical health events.

FIG. 4 schematically illustrates an example diagnostic control assembly 128 including (or be a component of) a supervisory control unit 130 associated with an example hydraulic fracturing unit 102 including example sensors, according to some embodiments of the disclosure. Although FIG. 4 only depicts a single hydraulic fracturing unit 102 and associated components, the diagnostic control assembly 128 may be configured to monitor, interact with, and/or at least partially control operation of a plurality of hydraulic fracturing units 102 and associated components and sensors. In some embodiments, the diagnostic control assembly 128 may be configured to identify a status associated with components of one or more hydraulic fracturing units 102, which may include, for example, a prime mover 206 positioned to drive, via a transmission 212, a hydraulic fracturing pump 104 to pump fracturing fluid into a wellhead 106 via a manifold 108, for example, as previously described herein.

As shown in FIG. 4, the diagnostic control assembly 128 may include a plurality of sensors configured to generate one or more sensor signals indicative of operating parameters associated with one or more of the hydraulic fracturing units 102 and/or the manifold 108. In some embodiments, one or more of the sensors may be incorporated into the diagnostic control assembly 128, and in some embodiments, the sensors may be separate from the diagnostic control assembly 128 and may be configured to communicate with the diagnostic control assembly 128, for example, via the control network 328 (FIG. 3). One or more of the sensors shown in FIG. 4 may generally correspond to one or more of the transducers shown in FIG. 3.

In some embodiments, the diagnostic control assembly 128 may include a supervisory control unit 130, for example, as described herein. The supervisory control unit 130 may be configured to receive the plurality of sensor signals associated with operation of the system 100. Based at least in part on one or more the sensor signals received from one or more of the sensors, the supervisory control unit 130 may be configured to determine whether one or more of the plurality of sensors is generating signals outside a calibration range due, for example, to being out of calibration, wear, or damage. In some embodiments, when one or more of the sensors is generating signals outside the calibration range, the supervisory control unit 130 may be configured to generate a calibration signal indicative of the one or more sensors generating signals outside the calibration range. For example, the supervisory control unit 130 may be configured to communicate one or more signals to the output device(s) 330 via the control network 328 (FIG. 3). For example, the output device(s) 330 may provide a warning that one or more of the sensors is operating outside a calibration range. The warning may be visual, audible, and/or tactile (e.g., a vibration).

For example, the supervisory control unit 130, when determining whether one or more of the plurality of sensors is generating signals outside the calibration range, may be configured to receive a manifold pressure signal from a manifold pressure sensor 400 associated with the manifold 108 indicative of pressure associated with fluid flowing in the manifold 108. In some embodiments, the supervisory control unit 130 may also, or alternatively, be configured to receive a manifold flow rate signal from a manifold flow rate sensor 402 associated with the manifold 108. The supervisory control unit 130 may further be configured to receive unit pressure signals from a unit pressure sensor 404 (e.g., a unit pressure sensor 404 associated with the output of a respective one or more hydraulic fracturing units 102) indicative of pressure associated with fluid flowing from the respective hydraulic fracturing unit 102. In some embodiments, a unit flow rate sensor configured to generate signals indicative of flow rate from each of the respective hydraulic fracturing units may be used as an alternative or supplement to the unit pressure sensors.

In some embodiments, based at least in part on one or more of the manifold pressure signals or the unit pressure signals, the supervisory control unit 130 may be configured to determine whether the manifold pressure sensor 400 and/or one or more of the plurality of unit pressure sensors 404 is generating signals outside the calibration range. In some embodiments, the unit pressure sensors 404 may take the form of pump discharge pressure sensors 406, each of which may be associated with an output of a respective hydraulic fracturing pump 104 and may be configured to generate one or more pressure signals indicative of the pressure of fracturing fluid being discharged from the respective hydraulic fracturing pump 104. In some embodiments, the pump discharge pressure sensors 406 may be substituted with, or supplemented by, a respective pump flow rate sensor 408.

In some embodiments, the supervisory control unit 130 may be configured to determine whether the manifold pressure sensor 400 and/or one or more of the unit pressure sensors 404 (and/or pump discharge pressure sensors 406) is generating signals outside the calibration range by determining an average pressure associated with fluid flowing in the manifold 108 and fluid flowing from the hydraulic fracturing units 102. The supervisory control unit 130 may use the average pressure to identify the manifold pressure sensor 400 or the unit pressure sensors 404 as generating signals indicative of a pressure outside a pressure range of the average pressure. For example, in some embodiments, the manifold pressure sensor 400 and the unit pressure sensors 404 of the respective hydraulic fracturing units 102 should be generating sensor signals indicative of generally same pressure. In some embodiments, the supervisory control unit 130 may be configured to identify pressure sensors that are generating sensor signals outside a pressure range as needing calibration, recalibration, service, or replacement. In some embodiments, a pressure range of deviation from the average pressure may range from about 1% to about 10%, for example, from about 2% to about 8%, from about 2% to about 6%, from about 2% to about 4%, or from about 3% to about 5%.

In some embodiments, the supervisory control unit 130 may be configured to identify pressure sensors (and/or other types of sensors) as needing calibration, recalibration, service, or replacement by selecting two of the pressure sensors and determining whether one of the two pressure sensors is generating pressure signals indicative of the need to calibrate, recalibrate, service, or replace the pressure sensor. For example, the supervisory control unit 130 may be configured to select two pressure sensors for evaluation and thereafter identify the pressure sensors generating sensor signals indicative of the highest and lowest pressures associated with fluid flowing in the manifold 108 and fluid flowing from the one or more of the plurality of hydraulic fracturing units 102. Once the highest and lowest pressures are identified, the supervisory control unit 130 may be configured to determine a pressure difference by subtracting the lowest pressure from the highest pressure, and thereafter determine a pressure deviation by dividing the pressure difference by the highest pressure. Once the pressure deviation is determined, the supervisory control unit 130 may be configured to identify, based at least in part on the pressure deviation, the manifold pressure sensor and/or the unit pressure sensors (and/or the pump discharge pressure sensors) as generating signals outside a calibration range if the pressure deviation is greater than a threshold pressure deviation. The threshold pressure deviation may range from about 1% to about 10%, for example, from about 2% to about 8%, from about 3% to about 7%, from about 4% to about 6%, or about 5%.

In some embodiments, the supervisory control unit 130 may be configured to determine an extent to which a heat exchanger assembly 218 associated with one or more of the plurality of hydraulic fracturing units 102 is cooling fluid passing through the heat exchanger assembly 218. The hydraulic fracturing units 102 may include multiple heat exchanger assemblies 218. For example, the heat exchanger assemblies 218 may be associated with one or more of the prime mover 206 (e.g., with the intake air, the coolant, and/or the lubricant), the transmission 212 (e.g., with the transmission coolant and/or lubricant), the hydraulic fracturing pump 104 (e.g., with the pump lubricant), or any of the fluids of the auxiliary system 216 (e.g., with the inlet air, hydraulic fluid, coolant, and/or lubricant). In some such embodiments, the supervisory control unit 130, when it has been determined that the extent to which one or more of the heat exchanger assemblies 218 is cooling fluid is below a minimum cooling effectiveness, may be configured to generate a cooling signal indicative of the one or more heat exchanger assemblies 218 operating with a low effectiveness.

For example, the supervisory control unit 130 may be configured to determine a current inlet temperature associated with fluid flowing into an inlet of a given heat exchanger assembly 218. For example, an inlet temperature sensor 410 associated with the heat exchanger assembly 218 may be configured to generate signals indicative of the temperature of fluid flowing into the inlet of the heat exchanger assembly 218. The supervisory control unit 130 also may be configured to determine a current outlet temperature associated with the fluid flowing through an outlet of the heat exchanger assembly 218. For example, an outlet temperature sensor 412 associated with the heat exchanger assembly 218 may be configured to generate signals indicative of the temperature of fluid flowing through the outlet of the heat exchanger assembly 218. The supervisory control unit 130 may further be configured to compare one or more of the current inlet temperature or the current outlet temperature to historical data 414 associated with operation of the heat exchanger assembly 218 during prior operation. Based at least in part on the comparison, the supervisory control unit 130 may further be configured to determine the cooling effectiveness of the heat exchanger assembly 218, and/or whether the effectiveness indicates a degradation of its cooling capacity, for example, due to debris partially or fully blocking the inlet, heat transfer surfaces, and/or outlet of the heat exchanger assembly 218.

In some embodiments, the historical data 414 may include correlations between the cooling effectiveness of the heat exchanger assembly 218 (e.g., a particular one of the heat exchanger assemblies 218) and the inlet temperature of the heat exchanger assembly 218, the outlet temperature of the heat exchanger assembly 218, a prime mover air inlet temperature, a prime mover power output, and/or an ambient temperature (e.g., the temperature of the environment in which the fracturing operation is occurring). In some embodiments, the prime mover air inlet temperature may be used to approximate the ambient air temperature. For example, the historical data 414 may include correlations between the cooling effectiveness of the heat exchanger assembly 218 and the prime mover power output and/or prime mover air inlet temperature (and/or the ambient temperature). Thus, in some embodiments, the historical data 414 may include a look-up table that provides the historical cooling effectiveness for a heat exchanger assembly 218 for a given prime mover power output (or range of power outputs) and the ambient temperature (or a range of ambient temperatures), which may be approximated by the prime mover inlet temperature. In some embodiments, the supervisory control unit 130 may be configured to determine the prime mover power output and the ambient temperature and, based at least in part on these values, determine from the look-up table an expected cooling effectiveness of the heat exchanger assembly 218, for example, based on the historical data 414.

In some embodiments, the supervisory control unit 130 may be configured to update the historical data 414 during operation of the hydraulic fracturing unit 102, for example, periodically or intermittently. For example, while the hydraulic fracturing unit 102 is operating, the supervisory control unit 130 may collect and store data related to the current inlet and outlet temperature of the heat exchanger assembly 218, the ambient temperature (or the prime mover air inlet temperature), and the prime mover power output, and add the collected data to the look-up table to add to the historical data 414. In some embodiments, the supervisory control unit 130 may calculate the temperature difference between inlet and outlet temperatures of the heat exchanger assembly 218 and the cooling effectiveness (e.g., the cooling efficiency) for each set of data.

In some embodiments, the supervisory control unit 130 may be configured generate a fault signal indicative of the heat exchanger assembly 218 operating with a low effectiveness, for example, when the heat exchanger 218 is cooling fluid below a minimum cooling effectiveness. In some embodiments, the minimum cooling effectiveness may be predetermined or determined in real-time. For example, the minimum cooling effectiveness may be predetermined as a threshold below which the supervisory control unit 130 will generate a fault signal. In some embodiments, the supervisory control unit 130 will compare the current cooling effectiveness with historical cooling effectiveness from the historical data, and when the current cooling effectiveness drops below a certain threshold relative to the historical cooling effectiveness, the supervisory control unit 130 may generate a fault signal. With respect to real-time minimum cooling effectiveness, the supervisory control unit 130 may be configured to monitor the inlet and/or outer temperatures and/or determine the cooling effectiveness, and when changes in the inlet and/or outlet temperatures and/or the cooling effectiveness are indicative of a rate of degradation of cooling effectiveness greater than a threshold maximum rate of degradation, the supervisory control unit 130 may generate a fault signal.

In some embodiments, the supervisory control unit 130 may be configured to generate a first fault signal when the current cooling effectiveness drops below a first minimum cooling effectiveness, and a second fault signal when the current cooling effectiveness drops below a second minimum cooling effectiveness. The first fault signal may provide a warning to an operator or user via the output device 330 indicating a need to service the heat exchanger assembly 218 soon (e.g., at the next scheduled maintenance event). The second fault signal may provide a warning to an operator or user via the output device 330 indicating an urgent need to service the heat exchanger assembly 218, for example, to clean a radiator of the heat exchanger assembly 218 (e.g., prior to the next scheduled maintenance event).

In some embodiments, the supervisory control unit 130 may be configured to calculate an average temperature difference between the inlet temperature and the outlet temperature for the heat exchanger assembly 218, for example, based on a summation of temperature differences over time divided by the number of temperature differences used in the summation. In some embodiments, these average temperature differences may be updated with each data set collected during operation of the hydraulic fracturing unit 102 and added to the historical data. With each new (current) average temperature difference, the current average temperature difference, within a given range of prime mover power outputs and a corresponding given range of ambient temperatures, the current average temperature difference may be compared to the first average temperature difference calculated and stored in the historical data 414. In some embodiments, when the current average temperature difference deviates from the first average temperature difference by more than a first average temperature difference threshold, the supervisory control unit 130 may be configured to generate the first fault signal. When the current average temperature difference deviates from the first average temperature difference by more than a second average temperature difference threshold (e.g., greater than the first average temperature difference threshold), the supervisory control unit 130 may be configured to generate the second fault signal.

For example, the first average temperature difference between the inlet and the outlet of the heat exchanger assembly 218, for a given prime mover power output range and/or a given ambient temperature range, may equal a first temperature difference. During operation of the hydraulic fracturing unit 102, the supervisory control unit 130 may continue to collect and determine multiple average temperature differences. In some embodiments, every time (or periodically or intermittently) a new average temperature difference is determined, the supervisory control unit 130 may compare the newly determined average temperature difference between the inlet and the outlet of the heat exchanger assembly 218. If the supervisory control unit 130 determines that the newly determined average temperature difference has deviated from the first average temperature difference by more than the first average temperature difference threshold, the supervisory control unit 130 may be configured to generate the first fault signal. If the supervisory control unit 130 determines that the newly determined average temperature difference has deviated from the first average temperature difference by more than the second average temperature difference threshold, the supervisory control unit 130 may be configured to generate the second fault signal. This example process may be performed for one or more (e.g., each) of the heat exchanger assemblies 218 on one or more (e.g., each) of the hydraulic fracturing units 102 of the hydraulic fracturing system 100.

In some embodiments, the fault signals may be communicated to the output device(s) 330 (FIG. 3), and the output device(s) 330 may provide an operator or user with a warning that the heat exchanger assembly 218 is not operating according to normal effectiveness due, for example, to dirt or debris partially or fully obstructing the cooling surfaces. The warning may be visual, audible, and/or tactile (e.g., a vibration).

As shown in FIG. 4, some embodiments of the supervisory control unit 130 may be configured to determine whether a fluid parameter associated with the auxiliary system 216 associated with one or more (e.g., each) of the hydraulic fracturing units 102 is indicative of a fluid-related problem, and when the fluid parameter is indicative of a fluid-related problem, generate a fluid signal indicative of the fluid-related problem. For example, the supervisory control unit 130 may be configured to receive a fluid level signal from a fluid level sensor 416 indicative of a level of fluid in a fluid reservoir. For example, the auxiliary system 218 may include an engine (e.g., a diesel engine) to generate mechanical power for operating components of the auxiliary system 218, and the fluid level sensor may be configured to generate signals indicative a fuel level in a fuel tank and/or signals indicative of the level of hydraulic fluid in a hydraulic fluid reservoir. In some embodiments, when the fluid level signal is indicative of a fluid level below a minimum fluid level, the supervisory control unit 130 may be configured to generate a low level signal indicative of the fluid level being below the minimum fluid level. In some embodiments, this may prevent commencement or completion of performance of a fracturing operation until the fluid level is increase.

In some embodiments, determining whether a fluid parameter is indicative of a fluid-related problem may include determining whether the quality of fluid associated with the auxiliary system 218 is below a minimum fluid quality. The fluid may be fuel, coolant, lubricant, and/or hydraulic fluid. For example, the supervisory control unit 218 may be configured to receive a fluid quality signal from a fluid quality sensor 418 indicative of a fluid quality of fluid in the auxiliary system 218, and when the fluid quality signal is indicative of a fluid quality below a minimum fluid quality, the supervisory control unit 130 may be configured to generate a low fluid quality signal indicative of the fluid quality being below the minimum fluid quality. For example, the supervisory control unit 130 may be configured to generate a fault signal indicative of the low fluid quality, and the fault signal may be communicated to the output device(s) 330 (FIG. 3). The output device(s) 330 may provide an operator or user with a warning that the fluid associated with the auxiliary system 218 is low and needs to be changed. The warning may be visual, audible, and/or tactile (e.g., a vibration). In some embodiments, the supervisory control unit 130 may be further configured to prevent a hydraulic fracturing unit 102 associated with the low fluid quality signal from commencing or completing performance of a hydraulic fracturing operation, or generate a maintenance signal indicative of initiating maintenance associated with the fluid.

In some embodiments, determining whether a fluid parameter is indicative of a fluid-related problem may include receiving a fluid temperature signal from a fluid temperature sensor 420 indicative of a temperature of fluid associated with the auxiliary system 218. When the fluid temperature signal is indicative of a fluid temperature outside an operating temperature range, the supervisory control unit 130 may be configured to generate a fluid temperature range signal indicative of the fluid temperature being outside the operating temperature range. For example, the supervisory control unit 130 may be configured to generate a fault signal indicative of either a low temperature or a high temperature, depending on whether the temperature is too low or too high (e.g., either below a low threshold temperature or above a high threshold temperature). The fault signal may be communicated to the output device(s) 330 (FIG. 3). The output device(s) 330 may provide an operator or user with a warning that the fluid associated with the auxiliary system 218 not within an operating temperature range. The warning may be visual, audible, and/or tactile (e.g., a vibration). In some embodiments, the supervisory control unit 130 may be further configured to prevent a hydraulic fracturing unit 102 associated with the low or high temperature from commencing or completing performance of a hydraulic fracturing operation.

In some embodiments, the supervisory control unit 130 may be configured to determine whether lubrication associated with the prime mover 206, the hydraulic fracturing pump 104, and/or the transmission 212 associated with one or more of the hydraulic fracturing units 102 has a lubrication fluid temperature greater than a maximum lubrication temperature (and/or outside an operating temperature range) and/or has a lubrication pressure outside an operational lubrication pressure range. For example, the supervisory control unit 130 may be configured to receive signals from one or more of a lubrication temperature sensor 422 and/or a lubrication pressure sensor 424 of the prime mover 206, a lubrication temperature sensor 426 and/or a lubrication pressure sensor 428 of the transmission 212, and/or a lubrication temperature sensor 430 and/or a lubrication pressure sensor 432 of the hydraulic fracturing pump 104. When one or more components of one or more of the of hydraulic fracturing units 102 has a lubrication fluid temperature greater than the maximum lubrication temperature and/or a lubrication pressure outside the operational lubrication pressure range, the supervisory control unit 130 may be configured to generate a lubrication temperature signal and/or a lubrication pressure signal indicative of the lubrication fluid temperature greater than the maximum lubrication temperature (and/or outside an operational temperature range) and/or a lubrication pressure outside the lubrication operational pressure range. The signal(s) may include a fault signal communicated to the output device(s) 330 (FIG. 3). The output device(s) 330 may provide an operator or user with a warning that one or more components of one or more of the of hydraulic fracturing units 102 has a lubrication fluid temperature greater than the maximum lubrication temperature and/or a lubrication pressure outside the operational lubrication pressure range. The warning may be visual, audible, and/or tactile (e.g., a vibration). In some embodiments, the supervisory control unit 130 may be further configured to prevent a hydraulic fracturing unit 102 associated with the fault signal from commencing or completing performance of performing a hydraulic fracturing operation.

FIGS. 5, 6A, 6B, 7A, and 7B are block diagrams of example methods 500, 600, and 700 to identify inaccuracies of a plurality of pressure sensors associated with operating one or more hydraulic fracturing units, to determine a status of an auxiliary system associated with a hydraulic fracturing unit, and to determine a cooling effectiveness of a heat exchanger assembly associated with a hydraulic fracturing unit, respectively, according to embodiments of the disclosure, illustrated as a collection of blocks in logical flow graphs, which represent sequences of operations. In some embodiments, at least some portions of the methods 500, 600, and/or 700 may be combined into, for example, a combined and/or coordinated method, which may occur concurrently and/or substantially simultaneously during, or prior to, operation of one or more hydraulic fracturing units. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described blocks may be combined in any order and/or in parallel to implement the methods.

FIG. 5 depicts a flow diagram of an embodiment of an example method 500 to identify inaccuracies of a plurality of pressure sensors configured to generate signals indicative of fluid pressure associated with operation of components of a plurality of hydraulic fracturing units including a prime mover positioned to drive a hydraulic fracturing pump to pump fracturing fluid into a wellhead via a manifold, according to embodiments of the disclosure. For example, the method 500 may be configured to semi- or fully-autonomously identify inaccuracies of one or more pressure sensors associated with operation of a hydraulic fracturing system during a fracturing operation involving a plurality of hydraulic fracturing units, for example, as previously described herein.

The example method 500, at 502, may include receiving a plurality of unit pressure signals generated by a plurality of respective unit pressure sensors. The unit pressure signals may be indicative of respective output pressures of each of the plurality of hydraulic fracturing units. For example, a supervisory control unit may be configured to receive the pressure signals from pressure sensors associated with the fracturing fluid output of each of the hydraulic fracturing units during a fracturing operation, for example, as previously described herein. In some embodiments, the pressure sensors may be associated with the hydraulic fracturing pumps of each of the hydraulic fracturing units, for example, at the fracturing fluid discharge. In some embodiments, receipt of the unit pressure signals may occur during the hydraulic fracturing operation, enabling the identification of the inaccuracies during the fracturing operation.

At 504, the example method 500 may include receiving a manifold pressure signal generated by a manifold pressure sensor. The manifold pressure signals may be indicative of pressure associated with fluid flowing in the manifold of the hydraulic fracturing system. In some embodiments, the supervisory control unit may be configured to receive the manifold pressure signals, for example, as described previously herein.

The example method 500, at 506, may further include determining, based at least in part on the unit pressure signals and the manifold pressure signal, whether the manifold pressure sensor and/or one or more of the unit pressure sensors is generating signals outside a calibration range. In some embodiments, the supervisory control unit may be configured to make such a determination, for example, as described previously herein.

For example, at 508, the example method 500 may include determining an average pressure associated with fluid flowing in the manifold of the hydraulic fracturing system and fluid flowing from the hydraulic fracturing units (e.g., the fracturing fluid exiting the discharge of the hydraulic fracturing pumps). For example, the supervisory control unit may be configured to add the pressures output by each of the pressure sensors to determine a pressure summation and thereafter divide the pressure summation by the number of pressure sensors to determine the average pressure.

At 510, the example method 500 may include determining a pressure difference between the average pressure and the pressure output by each of the pressure sensors (e.g., the manifold pressure sensor and the unit pressure sensors). For example, for each of the pressure sensors, the supervisory control unit may be configured to determine a pressure difference between the average pressure and the pressure output by each of the pressure sensors, for example, as previously described herein.

The example method 500, at 512, may further include dividing the pressure difference by the average pressure to determine a pressure deviation for each of the pressure sensors. For example, the supervisory control unit may be configured to divide the pressure difference by the average pressure to determine a pressure deviation for each of the pressure sensors, for example, as previously described herein.

At 514, the example method 500 may further include determining whether any of the pressure sensors is generating pressure signals indicative of pressure outside a pressure range of the average pressure. For example, the supervisory control unit may be configured to determine, for each pressure sensor, whether the respective pressure deviation is greater than a predetermined pressure range representative of an acceptable difference between the average pressure and the actual pressure as measured by each of the pressure sensors. In some embodiments, pressure range of deviation from the average pressure may range from about 1% to about 10%, for example, from about 2% to about 8%, from about 2% to about 6%, from about 2% to about 4%, or from about 3% to about 5%.

If, at 514, it is determined that none of the pressure sensors is generating pressure signals indicative of pressure outside the pressure range, the example method 500 may include returning to 502 to continue monitoring the pressure sensor signals to identify any pressure sensors generating pressure signals indicative of a pressure outside the pressure range.

If, at 514, it is determined that any of the pressure sensors is generating pressure signals indicative of pressure outside the pressure range of the average pressure, at 516, the example method 500 may further include identifying the manifold pressure sensor and/or unit pressure sensors as generating signals indicative of a pressure outside a pressure range of the average pressure. For example, the supervisory control unit may be configured to, for each of the pressure sensors exhibiting a respective pressure deviation greater than the predetermined pressure range representative of an acceptable difference between the average pressure and the actual pressure, as measured by each of the pressure sensors, identify the manifold pressure sensor and/or unit pressure sensors as generating signals indicative of a pressure outside a pressure range.

At 518, the example method 500 may further include generating a fault signal providing an indication that one or more of the pressure sensors is generating signals indicative of a pressure greater than the predetermined pressure range. For example, the supervisory control unit may be configured to generate a fault indicative of the inaccuracy of the one or more pressure sensors, and in some embodiments, identify the one or more pressure sensors exhibiting the in accuracy, so that the source or problem associated with the inaccuracy may be identified and/or corrected. For example, fault signal(s) may be communicated to the output device(s), for example, as previously described herein. The output device(s) may provide an operator or user with a warning that one or more of the pressure sensors is generating inaccurate pressure signals. The warning may be visual, audible, and/or tactile (e.g., a vibration). Thereafter, the example method 500 may return to 502 to continue to monitor pressure signals generated by the pressure sensors from the sensors to identify inaccurate pressure readings.

In some embodiments, the method 500 may include identifying pressure sensors (and/or other types of sensors) as needing calibration, recalibration, service, or replacement by selecting two of the pressure sensors and determining whether one of the two pressure sensors is generating pressure signals indicative of the need to calibrate, recalibrate, service, or replace the pressure sensor. For example, the method may include selecting two pressure sensors for evaluation and thereafter identifying the pressure sensor generating sensor signals indicative of the highest and lowest pressures associated with fluid flowing in the manifold and fluid flowing from the hydraulic fracturing units. The method 500 may also include determining a pressure difference by subtracting the lowest pressure from the highest pressure, and determining a pressure deviation by dividing the pressure difference by the highest pressure. The method further may include identifying, based at least in part on the pressure deviation, the manifold pressure sensor and/or the unit pressure sensor (and/or the pump discharge pressure sensors) as generating signals outside a calibration range if the pressure deviation is greater than a threshold pressure deviation. For example, the threshold pressure deviation may range from about 1% to about 10%, for example, from about 2% to about 8%, from about 3% to about 7%, from about 4% to about 6%, or about 5%.

FIG. 6 depicts a flow diagram of an embodiment of an example method 600 to determine a status of an auxiliary system associated with a hydraulic fracturing unit according to embodiments of the disclosure. For example, the auxiliary system may include one or more components that are powered by a liquid fuel, such as an engine (e.g., a diesel engine), cooled by coolant, lubricated by lubricant, and/or that use a fluid (e.g., hydraulic fluid) to activate and/or control operation of fluid-powered actuators (e.g., hydraulic motors and/or hydraulic cylinders), for example, as described previously herein. In some embodiments, the method 600 may determine whether a fluid parameter associated with the auxiliary system of one or more of the hydraulic fracturing units associated with a hydraulic fracturing system is indicative of a fluid-related problem, and when the fluid parameter is indicative of a fluid-related problem, generate a fluid signal indicative of the fluid-related problem.

For example, at 602, the example method 600 may include receiving a fluid level signal indicative of a level of fluid in a fluid reservoir. For example, the supervisory control unit may be configured to receive a fluid level signal from a fluid level sensor, the fluid level signal being indicative of a fluid level in, for example, a reservoir containing a supply of fluid, such as a fuel tank or a hydraulic fluid reservoir.

At 604, the example method 600 may include, based at least in part of the fluid level signal, comparing the fluid level indicated by the fluid level signal with a predetermined minimum fluid level. For example, the supervisory control unit may be configured to receive a signal indicative of the minimum fluid level from an operator or user, for example, communicated to the supervisory control unit via a terminal including a graphic user interface prompting and/or facilitating selection or entry of a minimum fluid level.

At 606, the example method 600 may include determining whether the fluid level is below the minimum fluid level. For example, based on the comparison, the supervisory control unit may be configured to determine whether the fluid level is below the minimum fluid level.

If, at 606, it is determined that one or more of the fluids of the auxiliary system has a fluid level below the minimum fluid level, the example method 600, at 608, may include generating a low level signal indicative of the fluid level being below the minimum fluid level. For example, if the fluid level is the level of fuel in the fuel tank of an engine for powering the auxiliary system, and the minimum fluid level is one-third full, for example, the supervisory control unit may be configured to generate a low level signal indicative of the fluid level being below the minimum fluid level. The fuel level signal, in turn, may cause generation of a warning signal for the operator or user, for example, at the output device. For example, warning signal may be communicated to the output device, for example, as previously described herein. The output device may provide an operator or user with a warning that the fuel level is too low to commence or complete a hydraulic fracturing operation (e.g., a fracturing stage). The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started. In some embodiments, the warning signal may cause generation of a maintenance signal indicative of initiating maintenance associated with the fluid, such as refilling the fluid reservoir (e.g., refueling the auxiliary system).

In some embodiments, if at 606, it is determined that the fluid level is not below the minimum fluid level, the example method 600 may include advancing to 610. In some embodiments, at 610, the example method 600 may include receiving a fluid quality signal from a fluid quality sensor indicative of a fluid quality of fluid in the auxiliary system. For example, the fluid may include fuel, coolant, lubricant, or hydraulic fluid, and the fluid quality signal may be indicative a condition of the fluid, such as the presence of particulates, a need to replace the fluid, a lack of viscosity of a lubricant, or a lack of coolant capability for a coolant. In some embodiments, fluid quality may refer to one or more of many fluid characteristics, depending, for example, on the type of fluid.

At 612, the example method 600 may include comparing the fluid quality indicated by the fluid quality signal with a minimum fluid quality. For example, the supervisory control unit may be configured to determine the fluid quality based at least in part on the fluid quality signal and compare the determined fluid quality with a minimum fluid quality. In some embodiments, the minimum fluid quality associated with the different fluids of the auxiliary system may be stored in memory, and the supervisory control unit may be configured to access the stored minimum fluid quality and compare fluid quality indicated by the fluid quality signal with the minimum fluid quality.

At 614, the example method 600 may include determining whether the fluid quality is below the minimum fluid quality. For example, based on the comparison at 612, the supervisory control unit may be configured to determine whether the fluid quality is below the minimum fluid quality.

If, at 614, it is determined that one or more of the fluids of the auxiliary system has a fluid quality below the minimum fluid quality, the example method 600, at 616, may include generating a maintenance signal indicative of initiating maintenance associated with the fluid. For example, the supervisory control unit may be configured to generate a maintenance signal, so that maintenance (e.g., replacement) associated with the fluid may be scheduled or performed. In some embodiments, the supervisory control unit may be configured to generate a low fluid quality warning signal indicative of the fluid quality being below the minimum fluid quality. The low fluid quality signal, in turn, may cause generation of a warning signal for the operator or user, for example, at the output device. For example, the warning signal may be communicated to the output device, as previously described herein. The output device may provide an operator or user with a warning that the fluid quality low. The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started. In some embodiments, the warning signal may cause generation of a maintenance signal indicative of initiating maintenance associated with the fluid, such as replacing the fluid and/or a filter for filtering the fluid.

In some embodiments, if at 614, it is determined that the fluid quality is not below the minimum fluid quality, the example method 600 may include advancing to 618. In some embodiments, at 618, the example method 600 may include receiving a fluid temperature signal from a fluid temperature sensor indicative of a temperature of fluid in the auxiliary system. For example, the fluid temperature signal may be indicative the temperature of the fluid.

At 620 (FIG. 6B), the example method 600 may include comparing the temperature of the fluid with an operating temperature range consistent with normal operation of the component of the auxiliary system related to the fluid. For example, the supervisory control unit may be configured to determine the fluid temperature based at least in part on the fluid temperature signal and compare the determined fluid temperature with an operating temperature range. In some embodiments, the operating temperature range associated with the different fluids of the auxiliary system may be stored in memory, and the supervisory control unit may be configured to access the stored operating temperature range and compare determined temperature with the operating temperature range.

At 622, the example method 600 may include determining whether the fluid temperature is outside the operating temperature range (e.g., either below or above the operating temperature range). For example, based on the comparison at 620, the supervisory control unit may be configured to determine whether the temperature is outside the operating temperature range.

If, at 622, it is determined that the fluid temperature is outside the operating temperature range, at 624, the example method 600 may include generating a fluid temperature range signal indicative of the fluid temperature being outside the operating temperature range. For example, the supervisory control unit may be configured to generate a fluid temperature range signal indicative of the fluid temperature being outside the operating temperature range. For example, fluid temperature range signal may be communicated to the output device, for example, as previously described herein. The output device may provide an operator or user with a warning that the temperature is outside the operating range. The warning may be visual, audible, and/or tactile (e.g., a vibration). In some embodiments, the warning signal may cause an interlock associated with the hydraulic fracturing unit and/or the hydraulic fracturing system to prevent commencement of the fracturing operation or shut-down a fracturing operation that has already started.

At 626, the example method 600 may include determining whether the fluid temperature is lower than the operating temperature range or higher than the operating temperature range. For example, based at least in part on the comparison at 620, the supervisory control unit may be configured to determine whether the fluid temperature is lower than the operating temperature range or higher than the operating temperature range.

If, at 626, it is determined that the fluid temperature is lower than the operating temperature range, at 628, the example method 600 may include causing the hydraulic fracturing unit to continue idling before commencement of a fracturing operation to provide the component or components associated with the fluid to heat the fluid to the operating temperature range. In some embodiments, the example method 600 may thereafter return to 620 to continue to compare the fluid temperature with the operating temperature range until the fluid temperature reaches the operating temperature range.

If, at 626, it is determined that the fluid temperature is higher than the operating temperature range, at 630, the example method 600 may include generating a high temperature warning signal indicative of the fluid temperature being higher than the operating temperature range. For example, the supervisory control unit may be configured to generate a high temperature warning signal indicative of the fluid temperature being higher than the operating temperature range. The high temperature warning signal may be communicated to the output device, for example, as previously described herein. The output device may provide an operator or user with a warning that the fluid temperature is higher than the operating temperature range. The warning may be visual, audible, and/or tactile. In some embodiments, the warning signal may cause an interlock associated with the hydraulic fracturing unit and/or the hydraulic fracturing system to prevent commencement of the fracturing operation (if not already started) or shut-down a fracturing operation that has already started. In some embodiments, the warning signal may cause generation of a maintenance signal indicative of initiating maintenance associated with the hydraulic fracturing unit, for example, to determine the cause of the high temperature and/or provide an appropriate correction.

If, at 622, it is determined that the fluid temperature is within the operating temperature range, at 632, and the fracturing operation has not commenced, the example method 600 may include allowing the hydraulic fracturing unit to proceed to commencing with the fracturing operation, barring other conditions with the hydraulic fracturing system that may prevent commencement of the fracturing operation. If the fracturing operation has already commenced, the example method 600 may allow the fracturing operation to continue, barring other conditions that may cause shut-down of the fracturing operation.

FIG. 7 depicts a flow diagram of an embodiment of an example method 700 to determine a cooling effectiveness of a heat exchanger assembly associated with a hydraulic fracturing unit according to embodiments of the disclosure. For example, the hydraulic fracturing units may each include one or more heat exchanger assemblies configured to cool fluid, such as air or liquids associated with operation of the hydraulic fracturing units. For example, heat exchanger assemblies may be configured to cool coolant, hydraulic fluid, lubricant, fuel, and/or air used for operation of the hydraulic fracturing units. In some embodiments, the example method 700 may determine the cooling effectiveness of one or more of the heat exchanger assemblies.

At 702, the example method 700 may include receiving an inlet temperature signal indicative of an inlet temperature of fluid flowing through an inlet of a heat exchanger assembly.

For example, the supervisory control unit may be configured to receive inlet temperature signals from an inlet temperature sensor associated with the inlet of the heat exchanger assembly, for example, as previously described herein.

The example method 700, at 704, may include receiving an outlet temperature signal indicative of an outlet temperature of fluid flowing through an outlet of the heat exchanger assembly. For example, the supervisory control unit may be configured to receive outlet temperature signals from an outlet temperature sensor associated with the outlet of the heat exchanger assembly, for example, as previously described herein.

At 706, the example method 700 may include determining the inlet temperature associated with fluid flowing through the inlet of the heat exchanger assembly. For example, based at least in part on the inlet temperature signals, the supervisory control unit may be configured to determine the inlet temperature associated with fluid flowing through the inlet of the heat exchanger assembly.

At 708, the example method 700 may include determining the outlet temperature associated with fluid flowing through the outlet of the heat exchanger assembly. For example, based at least in part on the outlet temperature signals, the supervisory control unit may be configured to determine the outlet temperature associated with fluid flowing out the outlet of the heat exchanger assembly.

The example method 700, at 710, may include determining a temperature difference between the inlet temperature and the outlet temperature. For example, the supervisory control unit may be configured to subtract the outlet temperature from the inlet temperature to determine the temperature difference.

At 712, the example method 700 may include receiving one or more sensor signals indicative of a prime mover air inlet temperature, a prime mover power output, and/or an ambient temperature associated with the hydraulic fracturing unit associated with the heat exchanger assembly. For example, an air inlet temperature sensor associated with the prime mover may generate air inlet temperature signals indicative of the air inlet temperature of the prime mover, and the air inlet temperature signals may be communicated to the supervisory control unit. A power output sensor and/or calculation may be associated with the prime mover, and the power output sensor and/or calculation may be communicated to the supervisory control unit. An ambient temperature sensor associated with the hydraulic fracturing system, and the ambient temperature sensor may be configured to generate ambient temperature signals indicative of the ambient temperature of the surroundings of the hydraulic fracturing unit or system. The supervisory control unit may be configured to receive air inlet temperature signals, the power output sensor and/or calculation, and/or ambient temperature signals.

At 714, the example method 700 may include comparing the current temperature difference between the inlet and outlet of the heat exchanger assembly to historical data associated with operation of the heat exchanger assembly during prior operation. For example, the historical data may include correlations between the cooling effectiveness and the ambient temperature (or the prime mover air inlet temperature) and the prime mover power output, and the temperature difference between the inlet and outlet temperatures of the heat exchanger assembly. Using the historical data, for example, by accessing historical data stored in memory, the supervisory control unit may be configured to compare the current cooling effectiveness with the historical data, which may include cooling effectiveness as a function of the ambient temperature (or range thereof) and the current power output of the prime mover (or range thereof). The supervisory control unit may be configured to compare the current temperature difference to the temperature difference in the correlations of the historical data having similar or substantially matching characteristics of prime mover air inlet temperature, prime mover power output, and/or ambient temperature.

The example method 700, at 716, may include determining, based at least in part on the comparison, whether the current cooling effectiveness of the heat exchanger assembly is below a minimum cooling effectiveness. For example, under similar conditions, during prior fracturing operations, the heat exchanger assembly may have exhibited a cooling effectiveness corresponding to a temperature drop of the fluid being cooled between the inlet and the outlet of the heat exchanger assembly. The supervisory control unit may be configured to determine whether, based at least in part on the cooling effectiveness, the heat exchanger is cooling fluid below a minimum cooling effectiveness. For example, if during prior operation, under similar conditions, the heat exchanger assembly was able to reduce the temperature of the fluid passing through it by about twenty degrees Celsius (e.g., corrected for deviations from the current conditions) and during the current measurement, the heat exchanger assembly is only reducing the temperature by about five degrees, this may be an indication that the cooling effectiveness of the heat exchanger assembly has dropped below a minimum cooling effectiveness.

In some embodiments, comparing the current temperature difference between the inlet and outlet of the heat exchanger assembly to historical data associated with operation of the heat exchanger assembly during prior operation may include calculating a current average temperature difference between the inlet temperature and the outlet temperature for the heat exchanger assembly, for example, based on a summation of temperature differences over time divided by the number of temperature differences used in the summation. In some embodiments, these average temperature differences may be updated with each data set collected during operation of the hydraulic fracturing unit and added to the historical data. With each new (current) average temperature difference, the current average temperature difference, within a given range of prime mover power outputs and a corresponding given range of ambient temperatures, the current average temperature difference may be compared to the first average temperature difference calculated and stored in the historical data.

If at 716, it is determined that the current cooling effectiveness of the heat exchanger assembly is below a minimum cooling effectiveness, at 718, the example method 700 may include generating a first fault signal indicative of the heat exchanger assembly operating with a low effectiveness. For example, in some embodiments, when the current average temperature difference deviates from the first average temperature difference by more than a first average temperature difference threshold, the supervisory control unit may be configured to generate the first fault signal. In some embodiments, if the supervisory control unit determines that the cooling effectiveness of the heat exchanger assembly has dropped below the minimum cooling effectiveness, the supervisory control unit may be configured to generate a fault signal indicative of the heat exchanger assembly operating with a low effectiveness. The fault signal may be communicated to the output device(s), and the output device(s) may provide an operator or user with a warning that the heat exchanger assembly is not operating according to normal effectiveness due, for example, to dirt or debris partially or fully obstructing the cooling surfaces. The warning may be visual, audible, and/or tactile (e.g., a vibration).

At 720 (FIG. 7B), the example method 700 may include determining whether the current average temperature difference deviates from the first average temperature difference by more than a second average temperature difference threshold (e.g., greater than the first average temperature difference threshold).

If, at 720, it is determined that the current average temperature difference deviates from the first average temperature difference by more than a second average temperature difference threshold (e.g., greater than the first average temperature difference threshold), the example method 700, at 722, may include generating a second fault signal, for example, as previously described herein.

If, at 720, it is determined that the current average temperature difference does not deviate from the first average temperature difference by more than a second average temperature difference threshold, the example method 700 may include returning to 702 and continuing to monitor the effectiveness of the heat exchanger assembly.

If, at 716, it is determined that the current cooling effectiveness of the heat exchanger assembly is above the minimum cooling effectiveness, the example method 700 may include returning to 702 and continuing to monitor the effectiveness of the heat exchanger assembly.

It should be appreciated that subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

FIG. 8 illustrates an example supervisory control unit 130 configured for implementing certain systems and methods for detecting cavitation and/or pulsation associated with operating a hydraulic fracturing unit, according to embodiments of the disclosure, for example, as described herein. The supervisory control unit 130 may include one or more processor(s) 800 configured to execute certain operational aspects associated with implementing certain systems and methods described herein. The processor(s) 800 may communicate with a memory 802. The processor(s) 800 may be implemented and operated using appropriate hardware, software, firmware, or combinations thereof. Software or firmware implementations may include computer-executable or machine-executable instructions written in any suitable programming language to perform the various functions described. In some examples, instructions associated with a function block language may be stored in the memory 802 and executed by the processor(s) 800.

The memory 802 may be used to store program instructions that are loadable and executable by the processor(s) 800, as well as to store data generated during the execution of these programs. Depending on the configuration and type of the supervisory control unit 130, the memory 802 may be volatile (such as random access memory (RAM)) and/or non-volatile (such as read-only memory (ROM), flash memory, etc.). In some examples, the memory devices may include additional removable storage 804 and/or non-removable storage 806 including, but not limited to, magnetic storage, optical disks, and/or tape storage. The disk drives and their associated computer readable media may provide non-volatile storage of computer-readable instructions, data structures, program modules, and other data for the devices. In some implementations, the memory 802 may include multiple different types of memory, such as static random access memory (SRAM), dynamic random access memory (DRAM), or ROM.

The memory 802, the removable storage 804, and the non-removable storage 806 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

The supervisory control unit 130 may also include one or more communication connection(s) 808 that may facilitate a control device (not shown) to communicate with devices or equipment capable of communicating with the supervisory control unit 130. The supervisory control unit 130 may also include a computer system (not shown). Connections may also be established via various data communication channels or ports, such as USB or COM ports to receive cables connecting the supervisory control unit 130 to various other devices on a network. In some examples, the supervisory control unit 130 may include Ethernet drivers that enable the supervisory control unit 130 to communicate with other devices on the network. According to various examples, communication connections 808 may be established via a wired and/or wireless connection on the network.

The supervisory control unit 130 may also include one or more input devices 810, such as a keyboard, mouse, pen, voice input device, gesture input device, and/or touch input device. It may further include one or more output devices 812, such as a display, printer, speakers and/or vibration devices. The one or more output devices may generally correspond to the output device(s) 330 shown in FIG. 3. In some examples, computer-readable communication media may include computer-readable instructions, program modules, or other data transmitted within a data signal, such as a carrier wave or other transmission. As used herein, however, computer-readable storage media may not include computer-readable communication media.

Turning to the contents of the memory 802, the memory 802 may include, but is not limited to, an operating system (OS) 814 and one or more application programs or services for implementing the features and embodiments disclosed herein. Such applications or services may include remote terminal units 816 for executing certain systems and methods for controlling operation of the hydraulic fracturing units 102 (e.g., semi- or full-autonomously controlling operation of the hydraulic fracturing units 102), for example, upon receipt of one or more control signals generated by the supervisory control unit 130. In some embodiments, each of the hydraulic fracturing units 102 may include one or more remote terminal units 816. The remote terminal unit(s) 816 may reside in the memory 802 or may be independent of the supervisory control unit 130. In some examples, the remote terminal unit(s) 816 may be implemented by software that may be provided in configurable control block language and may be stored in non-volatile memory. When executed by the processor(s) 800, the remote terminal unit(s) 816 may implement the various functionalities and features associated with the supervisory control unit 130 described herein.

As desired, embodiments of the disclosure may include a supervisory control unit 130 with more or fewer components than are illustrated in FIG. 8. Additionally, certain components of the example supervisory control unit 130 shown in FIG. 8 may be combined in various embodiments of the disclosure. The supervisory control unit 130 of FIG. 8 is provided by way of example only.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including handheld devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

This is a continuation of U.S. Non-Provisional application Ser. No. 17/810,877, filed Jul. 6, 2022, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/551,359, filed Dec. 15, 2021, titled "AUTOMATED DIAGNOSTICS OF ELECTRONIC INSTRUMENTATION IN A SYSTEM FOR FRACTURING A WELL AND ASSOCIATED METHODS," which is a continuation of U.S. Non-Provisional application Ser. No. 17/395,298, filed Aug. 5, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,255,174, issued Feb. 22, 2022, which is a continuation of U.S. Non-Provisional application Ser. No. 17/301,247, filed Mar. 30, 2021, titled "AUTOMATED DIAGNOSTICS OF ELECTRONIC INSTRUMENTATION IN A SYSTEM FOR FRACTURING A WELL AND ASSOCIATED METHODS," now U.S. Pat. No. 11,220,895, issued Jan. 11, 2022, which claims priority to and the benefit of, under 35 U.S.C. § 119(e), U.S. Provisional Application No. 62/705,375, filed Jun. 24, 2020, titled "AUTOMATED DIAGNOSTICS OF ELECTRONIC INSTRUMENTATION IN A SYSTEM FOR FRACTURING A WELL AND ASSOCIATED METHODS," the disclosures of which are incorporated herein by reference in their entireties.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A diagnostic control assembly comprising:

one or more sensors positioned to generate one or more sensor signals indicative of operating parameters associated with one or more of: (a) one or more hydraulic fracturing units, or (b) one or more manifolds associated with the one or more hydraulic fracturing units; and a supervisory control unit configured to receive the one or more sensor signals and operate to determine when the one or more sensors is generating a signal outside of a calibration range, the supervisory control unit being further configured to:

(i) receive a manifold pressure signal indicative of pressure associated with fluid flowing in the one or more manifolds associated with the one or more hydraulic fracturing units from a manifold pressure sensor, the manifold pressure sensor being at least one of the one or more sensors, (ii) receive unit pressure signals indicative of pressure associated with fluid flowing from at least one unit pressure sensor associated with the one or more hydraulic fracturing units, the at least one unit pressure sensor being at least one of the one or more sensors, and (iii) determine, based at least in part on the one or more of the manifold pressure signal or the unit pressure signals, whether one or more of the manifold pressure sensor or the at least one unit pressure sensor is generating a signal outside the calibration range, the determination of whether one or more of the manifold pressure sensor or the at least one unit pressure sensor is generating a signal outside the calibration range comprises:

(x) determine an average pressure associated with fluid flowing in the one or more manifolds and fluid flowing from the one or more hydraulic fracturing units, and (y) identify one or more of the manifold pressure sensor or the at least one unit pressure sensor as generating a signal indicative of a pressure outside a pressure range of the average pressure that ranges from about 2% to about 4%.

2. The diagnostic control assembly of claim 1, wherein the supervisory control unit further is configured to determine when a fluid parameter associated with an auxiliary system of at least one of the one or more hydraulic fracturing units is indicative of a fluid-related problem, thereby to generate a fluid signal indicative of the fluid-related problem.

3. The diagnostic control assembly of claim 2, wherein the step of determine when a fluid parameter is indicative of a fluid-related problem comprises receive a fluid level signal indicative of a level of fluid in a fluid reservoir, and when the fluid level signal is indicative of a fluid level below a minimum fluid level, generate a low level signal indicative of the fluid level being below the minimum fluid level.

4. The diagnostic control assembly of claim 3, wherein the supervisory control unit further is configured to prevent a hydraulic fracturing unit, of the one or more hydraulic fracturing units associated with the low level signal, from performing a hydraulic fracturing operation until the fluid level is above the minimum fluid level.

5. The diagnostic control assembly of claim 2, wherein the step of determine whether a fluid parameter is indicative of a fluid-related problem comprises receive a fluid quality signal indicative of a fluid quality of fluid in the auxiliary system, and wherein when the fluid quality signal is indicative of a fluid quality below a minimum fluid quality, generate a low fluid quality signal indicative of the fluid quality being below the minimum fluid quality.

6. The diagnostic control assembly of claim 5, wherein the supervisory control unit further is configured to one or more of: (a) prevent a hydraulic fracturing unit, of the one or more hydraulic fracturing units, associated with the low fluid quality signal from performing a hydraulic fracturing operation, or (b) generate a maintenance signal indicative of initiating maintenance associated with the fluid.

7. The diagnostic control assembly of claim 2, wherein the step of determine whether a fluid parameter is indicative of a fluid-related problem comprises receive a fluid temperature signal indicative of a temperature of fluid in the auxiliary system, and when the fluid temperature signal is indicative of a fluid temperature outside an operating temperature range, generate a fluid temperature range signal indicative of the fluid temperature being outside the operating temperature range.

8. The diagnostic control assembly of claim 1, wherein the supervisory control unit further is configured to determine when lubrication associated with at least one of the one or more hydraulic fracturing units has a lubrication fluid temperature greater than a maximum lubrication temperature.

9. The diagnostic control assembly of claim 1, wherein the supervisory control unit further is configured to determine when an extent to which a heat exchanger assembly associated with at least one of the one or more hydraulic fracturing units is cooling fluid passing through the heat exchanger assembly below a minimum cooling effectiveness.

10. A supervisory control unit to monitor a status associated with components of one or more hydraulic fracturing units, the supervisory control unit comprising:

(A) memory having computer-readable instructions stored therein; and (B) one or more processors configured to access the memory, and execute the computer- readable instructions to cause the supervisory control unit to at least:

(1) receive one or more sensor signals, and (2) determine when the one or more sensor signals is indicative of a sensor generating a sensor signal outside a calibration range, thereby to generate a calibration signal indicative of the sensor generating a sensor signal outside the calibration range, the supervisory control unit being caused to:

(i) receive one or more manifold pressure signals indicative of pressure associated with fluid flowing in a manifold from a manifold pressure sensor, (ii) receive one or more unit pressure signals indicative of pressure associated with fluid flowing from one or more unit pressure sensors associated with the one or more hydraulic fracturing units, and (iii) determine, based at least in part on the one or more manifold pressure signals or the one or more unit pressure signals, whether one or more of (1) the manifold pressure sensor, or (2) the one or more unit pressure sensors is generating signals outside the calibration range, the determination of whether the one or more of the manifold pressure sensor or the one or more unit pressure sensors is generating signals outside the calibration range comprises:

(x) determine an average pressure associated with fluid flowing in the manifold and fluid flowing from the one or more hydraulic fracturing units, and (y) identify one or more of the manifold pressure sensors or the one or more unit pressure sensors as generating signals indicative of a pressure outside a pressure range of the average pressure that ranges from about 2% to about 4%.

11. The supervisory control unit of claim 10, wherein the one or more processors further is configured to determine when a fluid parameter associated with an auxiliary system of at least one of the one or more hydraulic fracturing units is indicative of a fluid-related problem.

12. The supervisory control unit of claim 11, wherein the step of determine when a fluid parameter is indicative of a fluid-related problem comprises receive a fluid level signal indicative of a level of fluid in a fluid reservoir, and when the fluid level signal is indicative of a fluid level below a minimum fluid level, generate a low level signal indicative of the fluid level being below the minimum fluid level.

13. The supervisory control unit of claim 12, wherein the supervisory control unit further is configured to prevent a hydraulic fracturing unit, of the one or more hydraulic fracturing units associated with the low level signal, from performing a hydraulic fracturing operation until the fluid level is above the minimum fluid level.

14. The supervisory control unit of claim 11, wherein the step of determine when a fluid parameter is indicative of a fluid-related problem comprises receive a fluid quality signal indicative of a fluid quality of fluid in the auxiliary system, and wherein when the fluid quality signal is indicative of a fluid quality below a minimum fluid quality, generate a low fluid quality signal indicative of the fluid quality being below the minimum fluid quality.

15. The supervisory control unit of claim 14, wherein the supervisory control unit further is configured to one or more of: (a) prevent a hydraulic fracturing unit, of the one or more hydraulic fracturing units, associated with the low fluid quality signal from performing a hydraulic fracturing operation, or (b) generate a maintenance signal indicative of initiating maintenance associated with the fluid.

16. The supervisory control unit of claim 11, wherein the step of determine when a fluid parameter is indicative of a fluid-related problem comprises receive a fluid temperature signal indicative of a temperature of fluid in the auxiliary system, and wherein when the fluid temperature signal is indicative of a fluid temperature outside an operating temperature range, generate a fluid temperature range signal indicative of the fluid temperature being outside the operating temperature range.

17. The supervisory control unit of claim 10, wherein the one or more processors further is configured to determine one or more of:

when lubrication associated with at least one of the one or more hydraulic fracturing units has a lubrication fluid temperature greater than a maximum lubrication temperature, or when an extent to which a heat exchanger assembly associated with the at least one of the one or more hydraulic fracturing units is cooling fluid passing through the heat exchanger assembly below a minimum cooling effectiveness.

18. A supervisory control unit to monitor a status of one or more components associated with one or more hydraulic fracturing units, the supervisory control unit comprising:

(A) memory having computer-readable instructions stored therein; and (B) one or more processors configured to access the memory, and execute the computer-readable instructions to cause the supervisory control unit to perform the following steps:

(i) receive one or more sensor signals, and (ii) determine one or more of:

(a) when the one or more of the sensor signals is indicative of a sensor generating a sensor signal outside a calibration range, thereby to generate a calibration signal indicative of the sensor generating a signal outside the calibration range, the supervisory control unit being caused to:

(q) receive one or more manifold pressure signals indicative of pressure associated with fluid flowing in a manifold from a manifold pressure sensor, (r) receive one or more unit pressure signals indicative of pressure associated with fluid flowing from one or more unit pressure sensors associated with the one or more hydraulic fracturing units, and (s) determine, based at least in part on the one or more manifold pressure signals or the one or more unit pressure signals, whether one or more of the manifold pressure sensor or the one or more of the unit pressure sensors is generating signals outside the calibration range, or (b) when a fluid parameter associated with an auxiliary system of the one or more hydraulic fracturing units is indicative of a fluid-related problem, thereby to generate a fluid signal indicative of the fluid-related problem, the determine when a fluid parameter is indicative of a fluid-related problem comprises determine when the extent to which a heat exchanger assembly is cooling fluid below the minimum cooling effectiveness, which comprises:

determine an inlet temperature associated with fluid flowing into an inlet of the heat exchanger assembly, determine an outlet temperature associated with the fluid flowing out of an outlet of the heat exchanger assembly, determine a temperature difference between the inlet temperature and the outlet temperature, and compare the temperature difference to historical data associated with operation of the heat exchanger assembly during prior operation, the historical data including correlations between cooling effectiveness and one or more of ambient air temperature, a prime mover air inlet temperature, or a prime mover power output.

19. The supervisory control unit of claim 18, wherein the one or more processors further cause the supervisory control unit to: (a) determine a current inlet temperature and a current outlet temperature, and (b) add the current inlet temperature and the current outlet temperature to the historical data.

20. A method to control one or more hydraulic fracturing units, the method comprising:

(A) receiving, at one or more controllers, one or more sensor signals indicative of operating parameters associated with one or more of: (1) at least one of the one or more hydraulic fracturing units or (2) one or more manifolds;

(B) generating, from the one or more controllers, a calibration signal indicative of the one or more sensor signals being outside a calibration range when one or more of: (1) a manifold pressure sensor associated with the one or more manifolds or (2) one or more unit pressure sensors, generates signals outside the calibration range;

(C) generating, from the one or more controllers, a fluid signal indicative of a fluid-related problem when a fluid parameter associated with an auxiliary system of the one or more hydraulic fracturing units indicates the fluid-related problem;

(D) generating, from the one or more controllers, a lubrication temperature signal indicative of a lubrication fluid temperature being greater than a selected maximum lubrication temperature when at least one of the one or more hydraulic fracturing units has a lubrication fluid temperature greater than the selected maximum lubrication temperature; and (E) generating, from the one or more controllers, a cooling signal indicative of a heat exchanger assembly operating with a low effectiveness when the heat exchanger assembly is cooling fluid below a selected minimum cooling effectiveness.

* * * * *